US008985222B2

(12) United States Patent
Dykstra et al.

(10) Patent No.: US 8,985,222 B2
(45) Date of Patent: Mar. 24, 2015

(54) METHOD AND APPARATUS FOR CONTROLLING FLUID FLOW USING MOVABLE FLOW DIVERTER ASSEMBLY

(75) Inventors: Jason D. Dykstra, Carrollton, TX (US); Michael L. Fripp, Carrollton, TX (US); Orlando DeJesus, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/442,021

(22) Filed: Apr. 9, 2012

(65) Prior Publication Data

US 2013/0092393 A1 Apr. 18, 2013

Related U.S. Application Data

(63) Continuation of application No. 12/770,568, filed on Apr. 29, 2010, now Pat. No. 8,708,050.

(51) Int. Cl.

| | |
|---|---|
| ***E21B 34/06*** | (2006.01) |
| ***E21B 43/12*** | (2006.01) |
| ***E21B 34/08*** | (2006.01) |

(52) U.S. Cl.

CPC ..... *E21B 34/08* (2013.01); *E21B 43/12* (2013.01)

USPC ..... 166/373; 166/319; 166/250.15

(58) Field of Classification Search

CPC ..... E21B 34/08; E21B 43/12

USPC ..... 166/373, 319, 250.15

See application file for complete search history.

(56) References Cited

U.S. PATENT DOCUMENTS

| | | | |
|---|---|---|---|
| 553,727 | A | 1/1896 | Van Sickle |
| 1,329,559 | A | 2/1920 | Tesla |
| 2,140,735 | A | 12/1938 | Clarke |
| 2,324,819 | A | 6/1941 | Butzbach |
| 2,762,437 | A | 9/1956 | Egan |
| 2,849,070 | A | 8/1958 | Maly |
| 2,945,541 | A | 7/1960 | Maly |
| 2,981,332 | A | 4/1961 | Miller |

(Continued)

FOREIGN PATENT DOCUMENTS

| | | |
|---|---|---|
| CN | 2214518 | 12/1995 |
| EP | 0834342 B1 | 1/1999 |

(Continued)

OTHER PUBLICATIONS

Tesar, "Fluidic Valves for Variable-Configuration Gas Treatment, Chemical Engineering Research and Design", 83 (A9), pp. 1111-1121, Jun. 27, 2005.

(Continued)

*Primary Examiner* — Yong-Suk (Philip) Ro

(57) ABSTRACT

Apparatus and methods for controlling the flow of fluid, such as formation fluid, through an oilfield tubular positioned in a wellbore extending through a subterranean formation. Fluid flow is autonomously controlled in response to change in a fluid flow characteristic, such as density or viscosity. A fluid diverter is movable between an open and closed position in response to fluid density change and operable to restrict fluid flow through a valve assembly inlet. The diverter can be pivotable, rotatable or otherwise movable in response to the fluid density change. The diverter is operable to control a fluid flow ratio through two valve inlets. The fluid flow ratio is used to operate a valve member to restrict fluid flow through the valve.

10 Claims, 15 Drawing Sheets

(56) References Cited

U.S. PATENT DOCUMENTS

| | | | |
|---|---|---|---|
| 2,981,333 | A | 4/1961 | Miller |
| 3,091,393 | A | 5/1963 | Sparrow |
| 3,186,484 | A | 6/1965 | Waterman |
| 3,216,439 | A | 11/1965 | Manion |
| 3,233,621 | A | 2/1966 | Manion |
| 3,233,622 | A | 2/1966 | Boothe |
| 3,256,899 | A | 6/1966 | Dexter |
| 3,266,510 | A | 8/1966 | Wadey |
| 3,267,946 | A | 8/1966 | Adams |
| 3,282,279 | A | 11/1966 | Manion |
| 3,375,842 | A | 4/1968 | Reader |
| 3,427,580 | A | 2/1969 | Brock |
| 3,461,897 | A | 8/1969 | Kwok |
| 3,470,894 | A | 10/1969 | Rimmer |
| 3,474,670 | A | 10/1969 | Rupert |
| 3,477,506 | A | 11/1969 | Malone |
| 3,486,975 | A | 12/1969 | Ripley |
| 3,489,009 | A | 1/1970 | Rimmer |
| 3,515,160 | A | 6/1970 | Cohen |
| 3,521,657 | A | 7/1970 | Ayers |
| 3,529,614 | A | 9/1970 | Nelson |
| 3,537,466 | A | 11/1970 | Chapin |
| 3,554,209 | A | 1/1971 | Brown |
| 3,566,900 | A | 3/1971 | Black |
| 3,575,804 | A | 4/1971 | Ripley |
| 3,586,104 | A | 6/1971 | Hyde |
| 3,598,137 | A | 8/1971 | Glaze |
| 3,620,238 | A | 11/1971 | Kawahata |
| 3,638,672 | A | 2/1972 | Smith |
| 3,643,676 | A | 2/1972 | Limage |
| 3,670,753 | A | 6/1972 | Healey |
| 3,704,832 | A | 12/1972 | Fix |
| 3,712,321 | A | 1/1973 | Bauer |
| 3,717,164 | A | 2/1973 | Griffin |
| 3,730,673 | A | 5/1973 | Straitz |
| 3,745,115 | A | 7/1973 | Olsen |
| 3,754,576 | A | 8/1973 | Zetterstrom |
| 3,756,285 | A | 9/1973 | Johnson |
| 3,776,460 | A | 12/1973 | Fichter |
| 3,850,190 | A | 11/1974 | Carlson |
| 3,860,519 | A | 1/1975 | Weatherford |
| 3,876,016 | A | 4/1975 | Stinson |
| 3,885,627 | A | 5/1975 | Berry et al. |
| 3,895,901 | A | 7/1975 | Schwartz |
| 3,927,849 | A | 12/1975 | Kovalenko |
| 3,942,557 | A | 3/1976 | Tsuchiya |
| 4,003,405 | A | 1/1977 | Haynes |
| 4,029,127 | A | 6/1977 | Thompson |
| 4,082,169 | A | 4/1978 | Bowles |
| 4,127,173 | A | 11/1978 | Watkins |
| 4,134,100 | A | 1/1979 | Funke |
| 4,138,669 | A | 2/1979 | Edison |
| 4,167,073 | A | 9/1979 | Tang |
| 4,167,873 | A | 9/1979 | Bahrton |
| 4,187,909 | A | 2/1980 | Erbstoesser |
| 4,268,245 | A | 5/1981 | Straitz, III |
| 4,276,943 | A | 7/1981 | Holmes |
| 4,279,304 | A | 7/1981 | Harper |
| 4,282,097 | A | 8/1981 | Kuepper |
| 4,286,627 | A | 9/1981 | Graf |
| 4,287,952 | A | 9/1981 | Erbstoesser |
| 4,291,395 | A | 9/1981 | Holmes |
| 4,303,128 | A | 12/1981 | Marr, Jr. |
| 4,307,204 | A | 12/1981 | Vidal |
| 4,307,653 | A | 12/1981 | Goes |
| 4,323,118 | A | 4/1982 | Bergmann |
| 4,323,991 | A | 4/1982 | Holmes |
| 4,345,650 | A | 8/1982 | Wesley |
| 4,364,232 | A | 12/1982 | Sheinbaum |
| 4,364,587 | A | 12/1982 | Samford |
| 4,385,875 | A | 5/1983 | Kanazawa |
| 4,390,062 | A | 6/1983 | Fox |
| 4,393,928 | A | 7/1983 | Warnock, Sr. |
| 4,396,062 | A | 8/1983 | Iskander |
| 4,418,721 | A | 12/1983 | Holmes |
| 4,442,903 | A | 4/1984 | Schutt |
| 4,467,833 | A | 8/1984 | Satterwhite |
| 4,485,780 | A | 12/1984 | Price |
| 4,491,186 | A | 1/1985 | Alder |
| 4,495,990 | A | 1/1985 | Titus |
| 4,518,013 | A | 5/1985 | Lazarus |
| 4,526,667 | A | 7/1985 | Parkhurst |
| 4,527,636 | A | 7/1985 | Bordon |
| 4,557,295 | A | 12/1985 | Holmes |
| 4,562,867 | A | 1/1986 | Stouffer |
| 4,570,675 | A | 2/1986 | Fenwick |
| 4,570,715 | A | 2/1986 | Van Meurs |
| 4,618,197 | A | 10/1986 | White |
| 4,648,455 | A | 3/1987 | Luke |
| 4,716,960 | A | 1/1988 | Eastlund |
| 4,747,451 | A | 5/1988 | Adams |
| 4,765,184 | A | 8/1988 | Delatore |
| 4,801,310 | A | 1/1989 | Bielefeldt |
| 4,805,407 | A | 2/1989 | Buchanan |
| 4,808,084 | A | 2/1989 | Tsubouchi |
| 4,817,863 | A | 4/1989 | Bragg |
| 4,846,224 | A | 7/1989 | Collins, Jr. |
| 4,848,991 | A | 7/1989 | Bielefeldt |
| 4,895,582 | A | 1/1990 | Bielefeldt |
| 4,911,239 | A | 3/1990 | Winckler |
| 4,919,201 | A | 4/1990 | Bridges |
| 4,919,204 | A | 4/1990 | Baker |
| 4,921,438 | A | 5/1990 | Godfrey |
| 4,945,995 | A | 8/1990 | Tholance |
| 4,967,048 | A | 10/1990 | Langston |
| 4,974,674 | A | 12/1990 | Wells |
| 4,984,594 | A | 1/1991 | Vinegar |
| 4,998,585 | A | 3/1991 | Newcomer |
| RE33,690 | E | 9/1991 | Adams, Jr. |
| 5,058,683 | A | 10/1991 | Godfrey |
| 5,076,327 | A | 12/1991 | Mettner |
| 5,080,783 | A | 1/1992 | Brown |
| 5,099,918 | A | 3/1992 | Bridges |
| 5,154,835 | A | 10/1992 | Demichael |
| 5,165,450 | A | 11/1992 | Marrelli |
| 5,166,677 | A | 11/1992 | Schoenberg |
| 5,184,678 | A | 2/1993 | Pechkov |
| 5,202,194 | A | 4/1993 | Vanberg |
| 5,207,273 | A | 5/1993 | Cates |
| 5,207,274 | A | 5/1993 | Streich |
| 5,228,508 | A | 7/1993 | Facteau |
| 5,251,703 | A | 10/1993 | Skinner |
| 5,279,363 | A | 1/1994 | Schultz |
| 5,282,508 | A | 2/1994 | Ellingsen |
| 5,303,782 | A | 4/1994 | Johanessen |
| 5,332,035 | A | 7/1994 | Schultz |
| 5,333,684 | A | 8/1994 | Walter |
| 5,337,808 | A | 8/1994 | Graham |
| 5,337,821 | A | 8/1994 | Peterson |
| 5,338,496 | A | 8/1994 | Talbot |
| 5,341,883 | A | 8/1994 | Ringgenberg |
| 5,343,963 | A | 9/1994 | Bouldin |
| 5,375,658 | A | 12/1994 | Schultz |
| 5,435,393 | A | 7/1995 | Brekke |
| 5,455,804 | A | 10/1995 | Holmes |
| 5,464,059 | A | 11/1995 | Kristiansen |
| 5,482,117 | A | 1/1996 | Kolpak |
| 5,484,016 | A | 1/1996 | Surjaatmadja |
| 5,505,262 | A | 4/1996 | Cobb |
| 5,516,603 | A | 5/1996 | Holcombe |
| 5,533,571 | A | 7/1996 | Surjaatmadja |
| 5,547,029 | A | 8/1996 | Rubbo |
| 5,570,744 | A | 11/1996 | Weingarten |
| 5,578,209 | A | 11/1996 | Weiss |
| 5,673,751 | A | 10/1997 | Head |
| 5,707,214 | A | 1/1998 | Schmidt |
| 5,730,223 | A | 3/1998 | Restarick |
| 5,803,179 | A | 9/1998 | Echols |
| 5,815,370 | A | 9/1998 | Sutton |
| 5,839,508 | A | 11/1998 | Tubel |
| 5,868,201 | A | 2/1999 | Bussear |
| 5,893,383 | A | 4/1999 | Facteau |
| 5,896,076 | A | 4/1999 | Van Namen |
| 5,896,928 | A | 4/1999 | Coon |

(56) References Cited

U.S. PATENT DOCUMENTS

| | | | |
|---|---|---|---|
| 6,009,951 | A | 1/2000 | Coronado |
| 6,015,011 | A | 1/2000 | Hunter |
| 6,032,733 | A | 3/2000 | Ludwig |
| 6,078,471 | A | 6/2000 | Fiske |
| 6,098,020 | A | 8/2000 | DenBoer |
| 6,109,370 | A | 8/2000 | Gray |
| 6,109,372 | A | 8/2000 | Dorel et al. |
| 6,112,817 | A | 9/2000 | Voll |
| 6,164,375 | A | 12/2000 | Carisella |
| 6,176,308 | B1 | 1/2001 | Pearson |
| 6,179,052 | B1 | 1/2001 | Purkis |
| 6,199,399 | B1 | 3/2001 | Voorhis |
| 6,241,019 | B1 | 6/2001 | Davidson |
| 6,247,536 | B1 | 6/2001 | Leismer |
| 6,253,847 | B1 | 7/2001 | Stephenson |
| 6,253,861 | B1 | 7/2001 | Carmichael |
| 6,305,470 | B1 | 10/2001 | Woie |
| 6,315,043 | B1 | 11/2001 | Farrant |
| 6,315,049 | B1 | 11/2001 | Hickey |
| 6,320,238 | B1 | 11/2001 | Kizilyalli et al. |
| 6,336,502 | B1 | 1/2002 | Surjaatmadja |
| 6,345,963 | B1 | 2/2002 | Thomin |
| 6,367,547 | B1 | 4/2002 | Towers |
| 6,371,210 | B1 | 4/2002 | Bode |
| 6,374,858 | B1 | 4/2002 | Hides |
| 6,397,950 | B1 | 6/2002 | Streich |
| 6,405,797 | B2 | 6/2002 | Davidson |
| 6,426,917 | B1 | 7/2002 | Tabanou |
| 6,431,282 | B1 | 8/2002 | Bosma |
| 6,433,991 | B1 | 8/2002 | Deaton |
| 6,450,263 | B1 | 9/2002 | Schwendemann |
| 6,464,011 | B2 | 10/2002 | Tubel |
| 6,470,970 | B1 | 10/2002 | Purkis |
| 6,497,252 | B1 | 12/2002 | Kohler |
| 6,505,682 | B2 | 1/2003 | Brockman |
| 6,516,888 | B1 | 2/2003 | Gunnarson |
| 6,540,263 | B1 | 4/2003 | Sausner |
| 6,544,691 | B1 | 4/2003 | Guidotti |
| 6,547,010 | B2 | 4/2003 | Hensley |
| 6,567,013 | B1 | 5/2003 | Purkis |
| 6,575,237 | B2 | 6/2003 | Purkis |
| 6,575,248 | B2 | 6/2003 | Zhang |
| 6,585,051 | B2 | 7/2003 | Purkis |
| 6,619,394 | B2 | 9/2003 | Soliman |
| 6,622,794 | B2 | 9/2003 | Zisk, Jr. |
| 6,627,081 | B1 | 9/2003 | Hilditch |
| 6,644,412 | B2 | 11/2003 | Bode |
| 6,668,936 | B2 | 12/2003 | Williamson, Jr. |
| 6,672,382 | B2 | 1/2004 | Schultz |
| 6,679,324 | B2 | 1/2004 | Den Boer |
| 6,679,332 | B2 | 1/2004 | Vinegar |
| 6,691,781 | B2 | 2/2004 | Grant |
| 6,695,067 | B2 | 2/2004 | Johnson |
| 6,705,085 | B1 | 3/2004 | Braithwaite |
| 6,708,763 | B2 | 3/2004 | Howard |
| 6,719,048 | B1 | 4/2004 | Ramos |
| 6,719,051 | B2 | 4/2004 | Hailey, Jr. |
| 6,725,925 | B2 | 4/2004 | Al-Ramadhan |
| 6,769,498 | B2 | 8/2004 | Hughes |
| 6,786,285 | B2 | 9/2004 | Johnson |
| 6,812,811 | B2 | 11/2004 | Robison |
| 6,817,416 | B2 | 11/2004 | Wilson |
| 6,834,725 | B2 | 12/2004 | Whanger |
| 6,840,325 | B2 | 1/2005 | Stephenson |
| 6,851,473 | B2 | 2/2005 | Davidson |
| 6,851,560 | B2 | 2/2005 | Reig |
| 6,857,475 | B2 | 2/2005 | Johnson |
| 6,857,476 | B2 | 2/2005 | Richards |
| 6,886,634 | B2 | 5/2005 | Richards |
| 6,907,937 | B2 | 6/2005 | Whanger |
| 6,913,079 | B2 | 7/2005 | Tubel |
| 6,935,432 | B2 | 8/2005 | Nguyen |
| 6,957,703 | B2 | 10/2005 | Trott |
| 6,958,704 | B2 | 10/2005 | Vinegar |
| 6,967,589 | B1 | 11/2005 | Peters |
| 6,976,507 | B1 | 12/2005 | Webb |
| 7,007,756 | B2 | 3/2006 | Lerche |
| 7,011,101 | B2 | 3/2006 | Bowe |
| 7,011,152 | B2 | 3/2006 | Soelvik |
| 7,013,979 | B2 | 3/2006 | Richard |
| 7,017,662 | B2 | 3/2006 | Schultz |
| 7,025,134 | B2 | 4/2006 | Byrd |
| 7,038,332 | B2 | 5/2006 | Robison |
| 7,040,391 | B2 | 5/2006 | Leuthen |
| 7,043,937 | B2 | 5/2006 | Lifson |
| 7,059,401 | B2 | 6/2006 | Bode |
| 7,063,162 | B2 | 6/2006 | Oaling |
| 7,066,261 | B2 | 6/2006 | Vicente |
| 7,096,945 | B2 | 8/2006 | Richards |
| 7,100,686 | B2 | 9/2006 | Wittrisch |
| 7,108,083 | B2 | 9/2006 | Simonds |
| 7,114,560 | B2 | 10/2006 | Nguyen |
| 7,143,832 | B2 | 12/2006 | Freyer |
| 7,168,494 | B2 | 1/2007 | Starr |
| 7,185,706 | B2 | 3/2007 | Freyer |
| 7,199,480 | B2 | 4/2007 | Fripp |
| 7,207,386 | B2 | 4/2007 | Brannon |
| 7,213,650 | B2 | 5/2007 | Lehman |
| 7,213,681 | B2 | 5/2007 | Birchak |
| 7,216,738 | B2 | 5/2007 | Birchak |
| 7,258,169 | B2 | 8/2007 | Fripp |
| 7,290,606 | B2 | 11/2007 | Coronado |
| 7,318,471 | B2 | 1/2008 | Rodney |
| 7,322,409 | B2 | 1/2008 | Wittle |
| 7,322,416 | B2 | 1/2008 | Burris |
| 7,350,577 | B2 | 4/2008 | Howard |
| 7,363,967 | B2 | 4/2008 | Burris |
| 7,404,416 | B2 | 7/2008 | Schultz |
| 7,405,998 | B2 | 7/2008 | Webb |
| 7,409,999 | B2 | 8/2008 | Henriksen |
| 7,413,010 | B2 | 8/2008 | Blauch |
| 7,419,002 | B2 | 9/2008 | Oybevik |
| 7,426,962 | B2 | 9/2008 | Moen |
| 7,440,283 | B1 | 10/2008 | Rafie |
| 7,455,104 | B2 | 11/2008 | Duhon |
| 7,464,609 | B2 | 12/2008 | Fallet |
| 7,468,890 | B2 | 12/2008 | Lin |
| 7,469,743 | B2 | 12/2008 | Richards |
| 7,520,321 | B2 | 4/2009 | Hiron |
| 7,537,056 | B2 | 5/2009 | Macdougall |
| 7,578,343 | B2 | 8/2009 | Augustine |
| 7,621,336 | B2 | 11/2009 | Badalamenti |
| 7,644,773 | B2 | 1/2010 | Richard |
| 7,686,078 | B2 | 3/2010 | Khomynets |
| 7,699,102 | B2 | 4/2010 | Storm |
| 7,708,068 | B2 | 5/2010 | Hailey, Jr. |
| 7,780,152 | B2 | 8/2010 | Rao |
| 7,814,973 | B2 | 10/2010 | Dusterhoft |
| 7,828,067 | B2 | 11/2010 | Scott |
| 7,857,050 | B2 | 12/2010 | Zazovsky |
| 7,882,894 | B2 | 2/2011 | Nguyen |
| 7,918,272 | B2 | 4/2011 | Gaudette |
| 8,016,030 | B1 | 9/2011 | Prado Garcia |
| 8,025,103 | B1 | 9/2011 | Wolinsky |
| 8,083,935 | B2 | 12/2011 | Eia |
| 8,127,856 | B1 | 3/2012 | Nish |
| 8,191,627 | B2 | 6/2012 | Hamid |
| 8,196,665 | B2 | 6/2012 | Wolinsky |
| 8,235,128 | B2 | 8/2012 | Dykstra |
| 8,261,839 | B2 | 9/2012 | Fripp |
| 8,272,443 | B2 | 9/2012 | Watson |
| 8,276,669 | B2 | 10/2012 | Dykstra |
| 8,302,696 | B2 | 11/2012 | Williams et al. |
| 2002/0148607 | A1 | 10/2002 | Pabst |
| 2002/0150483 | A1 | 10/2002 | Ursan |
| 2003/0173086 | A1 | 9/2003 | Howard |
| 2004/0011561 | A1 | 1/2004 | Hughes |
| 2005/0110217 | A1 | 5/2005 | Wood |
| 2005/0150657 | A1 | 7/2005 | Howard |
| 2005/0173351 | A1 | 8/2005 | Neofotistos |
| 2005/0214147 | A1 | 9/2005 | Schultz |
| 2006/0076150 | A1 | 4/2006 | Coronado |
| 2006/0113089 | A1 | 6/2006 | Henriksen |
| 2006/0131033 | A1 | 6/2006 | Bode |

(56) References Cited

U.S. PATENT DOCUMENTS

| | | | |
|---|---|---|---|
| 2006/0185849 | A1 | 8/2006 | Edwards |
| 2007/0012454 | A1 | 1/2007 | Ross |
| 2007/0028977 | A1 | 2/2007 | Goulet |
| 2007/0045038 | A1 | 3/2007 | Han |
| 2007/0107719 | A1 | 5/2007 | Blacker |
| 2007/0169942 | A1 | 7/2007 | Loretz |
| 2007/0173397 | A1 | 7/2007 | Hinman |
| 2007/0193752 | A1 | 8/2007 | Kim |
| 2007/0246225 | A1 | 10/2007 | Hailey |
| 2007/0246407 | A1 | 10/2007 | Richards |
| 2007/0256828 | A1 | 11/2007 | Birchak |
| 2008/0035330 | A1 | 2/2008 | Richards |
| 2008/0041580 | A1 | 2/2008 | Freyer |
| 2008/0041581 | A1 | 2/2008 | Richards |
| 2008/0041582 | A1 | 2/2008 | Saetre |
| 2008/0041588 | A1 | 2/2008 | Richards |
| 2008/0149323 | A1 | 6/2008 | Omalley |
| 2008/0169099 | A1 | 7/2008 | Pensgaard |
| 2008/0236839 | A1 | 10/2008 | Oddie |
| 2008/0251255 | A1 | 10/2008 | Forbes |
| 2008/0261295 | A1 | 10/2008 | Butler |
| 2008/0283238 | A1 | 11/2008 | Richards |
| 2008/0314578 | A1 | 12/2008 | Jackson |
| 2008/0314590 | A1 | 12/2008 | Patel |
| 2009/0000787 | A1 | 1/2009 | Hill |
| 2009/0008088 | A1 | 1/2009 | Schultz |
| 2009/0008090 | A1 | 1/2009 | Schultz |
| 2009/0009297 | A1 | 1/2009 | Shinohara |
| 2009/0009333 | A1 | 1/2009 | Bhogal |
| 2009/0009336 | A1 | 1/2009 | Ishikawa |
| 2009/0009412 | A1 | 1/2009 | Warther |
| 2009/0009437 | A1 | 1/2009 | Hwang |
| 2009/0009445 | A1 | 1/2009 | Lee |
| 2009/0009447 | A1 | 1/2009 | Naka |
| 2009/0020292 | A1 | 1/2009 | Loretz |
| 2009/0065197 | A1 | 3/2009 | Eslinger |
| 2009/0078427 | A1 | 3/2009 | Patel |
| 2009/0078428 | A1 | 3/2009 | Ali |
| 2009/0101342 | A1 | 4/2009 | Gaudette |
| 2009/0101344 | A1 | 4/2009 | Crow |
| 2009/0101352 | A1 | 4/2009 | Coronado |
| 2009/0101354 | A1 | 4/2009 | Holmes |
| 2009/0114395 | A1* | 5/2009 | Holmes et al. ..... 166/319 |
| 2009/0120647 | A1 | 5/2009 | Turick |
| 2009/0133869 | A1 | 5/2009 | Clem |
| 2009/0145609 | A1 | 6/2009 | Holmes et al. |
| 2009/0151925 | A1 | 6/2009 | Richards |
| 2009/0159282 | A1 | 6/2009 | Webb |
| 2009/0188661 | A1 | 7/2009 | Bizon |
| 2009/0205831 | A1 | 8/2009 | Jacob |
| 2009/0226301 | A1 | 9/2009 | Priestman et al. |
| 2009/0236102 | A1 | 9/2009 | Guest et al. |
| 2009/0250224 | A1 | 10/2009 | Wright et al. |
| 2009/0277639 | A1 | 11/2009 | Schultz |
| 2009/0277650 | A1 | 11/2009 | Casciaro |
| 2009/0301730 | A1 | 12/2009 | Gweily |
| 2010/0025045 | A1 | 2/2010 | Lake |
| 2010/0122804 | A1 | 5/2010 | Yang |
| 2010/0181251 | A1 | 7/2010 | Alspektor |
| 2010/0249723 | A1 | 9/2010 | Fangrow, Jr. |
| 2010/0300568 | A1 | 12/2010 | Faram |
| 2011/0017458 | A1 | 1/2011 | East |
| 2011/0042091 | A1 | 2/2011 | Dykstra |
| 2011/0042092 | A1 | 2/2011 | Fripp et al. |
| 2011/0042323 | A1 | 2/2011 | Sullivan |
| 2011/0079384 | A1 | 4/2011 | Russell |
| 2011/0139451 | A1 | 6/2011 | McKeen |
| 2011/0139453 | A1 | 6/2011 | Schultz |
| 2011/0186300 | A1 | 8/2011 | Dykstra et al. |
| 2011/0198097 | A1 | 8/2011 | Moen |
| 2011/0203671 | A1 | 8/2011 | Doig |
| 2011/0214871 | A1 | 9/2011 | Leduc et al. |
| 2011/0214876 | A1 | 9/2011 | Dykstra |
| 2011/0266001 | A1 | 11/2011 | Dykstra |
| 2011/0297384 | A1 | 12/2011 | Fripp |
| 2011/0297385 | A1 | 12/2011 | Dykstra |
| 2012/0048563 | A1 | 3/2012 | Holderman |
| 2012/0060624 | A1 | 3/2012 | Dykstra |
| 2012/0061088 | A1 | 3/2012 | Dykstra |
| 2012/0111577 | A1 | 5/2012 | Dykstra |
| 2012/0125120 | A1 | 5/2012 | Dykstra |
| 2012/0125626 | A1 | 5/2012 | Constantine |
| 2012/0138304 | A1 | 6/2012 | Dykstra |
| 2012/0145385 | A1 | 6/2012 | Lopez |
| 2012/0152527 | A1 | 6/2012 | Dykstra |
| 2012/0181037 | A1 | 7/2012 | Holderman |
| 2012/0211243 | A1 | 8/2012 | Dykstra |
| 2012/0234557 | A1 | 9/2012 | Dykstra |
| 2012/0255351 | A1 | 10/2012 | Dykstra |
| 2012/0255739 | A1 | 10/2012 | Fripp |
| 2012/0255740 | A1 | 10/2012 | Fripp |
| 2012/0305243 | A1 | 12/2012 | Hallundbaek et al. |
| 2013/0020088 | A1 | 1/2013 | Dyer et al. |
| 2013/0075107 | A1 | 3/2013 | Dykstra |

FOREIGN PATENT DOCUMENTS

| | | | |
|---|---|---|---|
| EP | 1672167 | A1 | 6/2006 |
| EP | 1857633 | | 11/2007 |
| EP | 1857633 | A2 | 11/2007 |
| WO | 0063530 | A1 | 10/2000 |
| WO | 0214647 | A2 | 2/2002 |
| WO | 03062597 | A1 | 7/2003 |
| WO | 2004012040 | A2 | 2/2004 |
| WO | 2004081335 | A2 | 9/2004 |
| WO | 2006015277 | A1 | 2/2006 |
| WO | 2008024645 | A2 | 2/2008 |
| WO | PCT/US08/075668 | | 9/2008 |
| WO | 2009081088 | A2 | 2/2009 |
| WO | 2009052076 | A2 | 4/2009 |
| WO | 2009052103 | A2 | 4/2009 |
| WO | 2009052149 | | 4/2009 |
| WO | PCT/US09/046363 | | 6/2009 |
| WO | PCT/US09/046404 | | 6/2009 |
| WO | 2009088292 | A1 | 7/2009 |
| WO | 2009088293 | A1 | 7/2009 |
| WO | 2009088624 | A2 | 7/2009 |
| WO | 2011002615 | A2 | 1/2011 |

OTHER PUBLICATIONS

"Fluidics", Microsoft Encarta Online Encylopedia, copyright 1997-2009.

Kirshner et al., "Design Theory of Fluidic Components", 1975, Academic Press, New York.

Kirshner, "Fluid Amplifiers", 1966, McGraw-Hill, New York.

Tesar, "New Ways of Fluid Flow Control in Automobiles: Experience with Exhaust Gas Aftertreatment Control", Seoul 2000 FISTA World Automotive Congress, Jun. 12-15, 2000, F2000H192.

Tesar, "Sampling by Fluidics and Microfluidics", Acta Polytechnica vol. 42 No. 2/2002, Jun. 24, 2005.

Angrist, "Fluid Control Device", Scientific American Dec. 1964, pp. 80-88, Dec. 1, 1964.

Freyer, "An Oil Selective Inflow Control System", SPE 78272, Oct. 2002.

European Search Report, Application No. EP 13 18 2098, Mail Date Nov. 13, 2013, 8 pages.

International Search Report and Written Opinion, PCT/US2012/032044, Mail Date Oct. 25, 2012, 9 pages.

Canadian Office Action, Application No. 2,737,998, Mail Date Jun. 21, 2013, 3 pages.

"Apparatus and Method of Inducting Fluidic Oscillation in a Rotating Cleaning Nozzle," ip.com, dated Apr. 24, 2007, 3 pages.

Stephen L. Crow, Martin P. Coronado, Rustom K. Mody, "Means for Passive Inflow Control Upon Gas Breakthrough," SPE 102208, 2006 SPE Annual Technical Conference and Exhibition, San Antonio, Texas, U.S.A., Sep. 24-27, 2006, 6 pages.

(56) References Cited

OTHER PUBLICATIONS

Gebben, Vernon D., "Vortex Valve Performance Power Index," NASA TM X-52257, May 1967, pp. 1-14 plus 2 cover pages and Figures 1-8, National Aeronautics and Space Administration.
Haakh, Dr.-Ing. Frieder, "Vortex Chamber Diodes as Throttle Devices in Pipe Systems. Computation of Transient Flow," Journal of Hydraulic Research, 2003, vol. 41, No. 1, pp. 53-59.
Holmes, Allen B., et al., "A fluidic approach to the design of a mud pulser for bore-hole telemetry while drilling," DRCMS Code: 7-36AA-7100, HDL Project: A54735, Aug. 1979, pp. 1,2,5,6,9-27, and 29-37, Department of the Interior, U.S. Geological Survey, Washington, D.C.
Lee Precision Micro Hydraulics, Lee Restrictor Selector product brochure; Jan. 2011, 9 pages.
The Lee Company Technical Center, "Technical Hydraulic Handbook," 11th Edition, copyright 1971-2009, 7 pages Connecticut.
Weatherford product brochure entitled, "Application Answers—Combating Coning by Creating Even Flow Distribution in Horizontal Sand-Control Completions," 2005, 4 pages, Weatherford.
J.D Willingham, H.C. Tan, L.R. Norman, "Perforation Friction Pressure of Fracturing Fluid Slurries," SPE 25891, SPE Rocky Mountain Regional/Low Permeability Reservoirs Symposium, Denver, Co., U.S.A., Apr. 12-14, 1993, 14 pages.
Masahiro Takebayashi, Hiroshi Iwata, Akio Sakazume, Hiroaki Hata, "Discharge Characteristics of an Oil Feeder Pump Using Nozzle Type Fluidic Diodes for a Horizontal Compressor Depending on the Driving Speed," International Compressor Engineering Conference, Paper 597, 1988, 9 pages.
Flossert "Constant Flow Rate Product Brochure", Dec. 2002, 1 page.
Savkar, An Experimental Study of Switching in a Bistable Fluid Amplifier, University of Michigan, Dec. 1966.
Chinese Office Action dated Apr. 18, 2014 for Application No. 201180008491.9.

* cited by examiner

METHOD AND APPARATUS FOR CONTROLLING FLUID FLOW USING MOVABLE FLOW DIVERTER ASSEMBLY

CROSS-REFERENCE TO RELATED APPLICATIONS

This application is a Continuation application of U.S. patent application Ser. No. 12/770,568, filed Apr. 29, 2010.

FIELD OF INVENTION

The invention relates to apparatus and methods for controlling fluid flow in a subterranean well having a movable flow control mechanism which actuates in response to a change of a characteristic of the fluid flow.

BACKGROUND OF INVENTION

During the completion of a well that traverses a subterranean formation, production tubing and various equipment are installed in the well to enable safe and efficient production of the formation fluids. For example, to control the flow rate of production fluids into the production tubing, it is common practice to install one or more inflow control devices within the tubing string.

Formations often produce multiple constituents in the production fluid, namely, natural gas, oil, and water. It is often desirable to reduce or prevent the production of one constituent in favor of another. For example, in an oil producing well, it may be desired to minimize natural gas production and to maximize oil production. While various downhole tools have been utilized for fluid separation and for control of production fluids, a need has arisen for a device for controlling the inflow of formation fluids. Further, a need has arisen for such a fluid flow control device that is responsive to changes in characteristic of the fluid flow as it changes over time during the life of the well and without requiring intervention by the operator.

SUMMARY

Apparatus and methods for controlling the flow of fluid, such as formation fluid, through an oilfield tubular positioned in a wellbore extending through a subterranean formation. Fluid flow is autonomously controlled in response to change in a fluid flow characteristic, such as density. In one embodiment, a fluid diverter is movable between an open and closed position in response to fluid density change and operable to restrict fluid flow through a valve assembly inlet. The diverter can be pivotable, rotatable or otherwise movable in response to the fluid density change. In one embodiment, the diverter is operable to control a fluid flow ratio through two valve inlets. The fluid flow ratio is used to operate a valve member to restrict fluid flow through the valve. In other embodiments, the fluid diverter moves in response to density change in the fluid to affect fluid flow patterns in a tubular, the change in flow pattern operating a valve assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear either explicitly or from context. Upstream and downstream are used to indication location or direction in relation to the surface, where upstream indicates relative position or movement towards the surface along the wellbore and downstream indicates relative position or movement further away from the surface along the wellbore.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not delimit the scope of the present invention.

Figure 1:
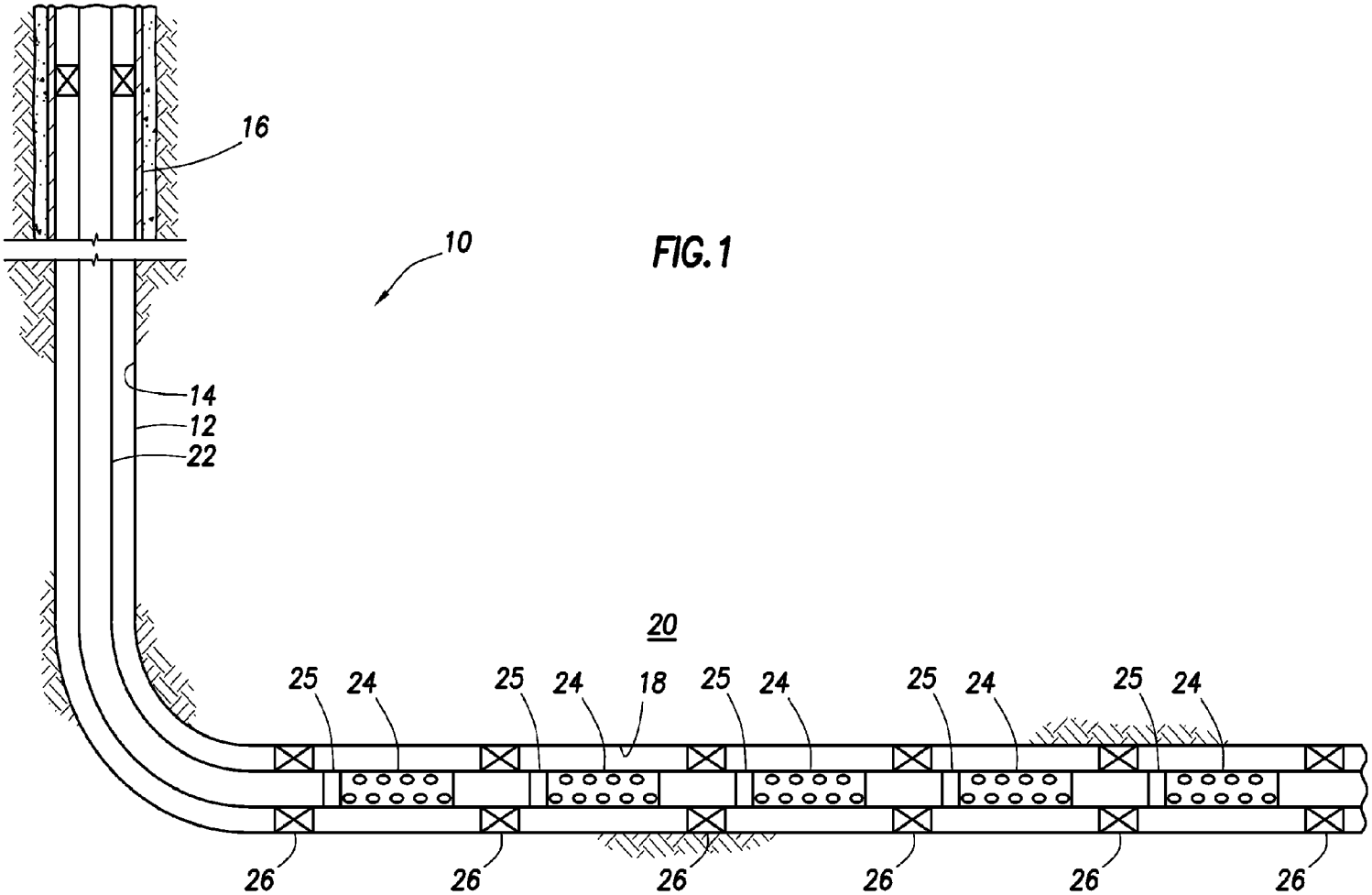
FIG. 1 is a schematic illustration of a well system including a plurality of autonomous fluid control assemblies according to the present invention.

FIG. 1 is a schematic illustration of a well system, indicated generally as 10, including a plurality of autonomous density-actuated fluid control assemblies embodying principles of the present invention. A wellbore 12 extends through various earth strata. Wellbore 12 has a substantially vertical section 14, the upper portion of which has installed therein a casing string 16. Wellbore 12 also has a substantially deviated section 18, shown as horizontal, that extends through a hydrocarbon bearing subterranean formation 20.

Positioned within wellbore 12 and extending from the surface is a tubing string 22. Tubing string 22 provides a conduit for formation fluids to travel from formation 20 upstream to the surface. Positioned within tubing string 22 in the various production intervals adjacent to formation 20 are a plurality of fluid control assemblies 25 and a plurality of production tubular sections 24. On either side of each production tubulars 24 is a packer 26 that provides a fluid seal between tubing string 22 and the wall of wellbore 12. Each pair of adjacent packers 26 defines a production interval.

In the illustrated embodiment, each of the production tubular sections 24 provides sand control capability. The sand control screen elements or filter media associated with production tubular sections 24 are designed to allow fluids to flow therethrough but prevent particulate matter of sufficient size from flowing therethrough. The exact design of the screen element associated with fluid flow control devices 24 is not critical to the present invention as long as it is suitably designed for the characteristics of the formation fluids and for any treatment operations to be performed.

The term "natural gas" as used herein means a mixture of hydrocarbons (and varying quantities of non-hydrocarbons) that exist in a gaseous phase at room temperature and pressure. The term does not indicate that the natural gas is in a gaseous phase at the downhole location of the inventive systems. Indeed, it is to be understood that the flow control system is for use in locations where the pressure and temperature are such that natural gas will be in a mostly liquefied state, though other components may be present and some components may be in a gaseous state. The inventive concept will work with liquids or gases or when both are present.

The formation fluid flowing into the production tubular 24 typically comprises more than one fluid component. Typical components are natural gas, oil, water, steam, or carbon dioxide. Steam, water, and carbon dioxide are commonly used as injection fluids to drive the hydrocarbon towards the production tubular, whereas natural gas, oil and water are typically found in situ in the formation. The proportion of these components in the formation fluid flowing into the production tubular will vary over time and based on conditions within the formation and wellbore. Likewise, the composition of the fluid flowing into the various production tubing sections throughout the length of the entire production string can vary significantly from section to section. The fluid control apparatus is designed to restrict production from an interval when it has a higher proportion of an undesired component based on the relative density of the fluid.

Accordingly, when a production interval corresponding to a particular one of the fluid control assemblies produces a greater proportion of an undesired fluid component, the fluid control apparatus in that interval will restrict production flow from that interval. Thus, the other production intervals which are producing a greater proportion of desired fluid component, for example oil, will contribute more to the production stream entering tubing string 22. Through use of the fluid control assemblies 25 of the present invention and by providing numerous production intervals, control over the volume and composition of the produced fluids is enabled. For example, in an oil production operation if an undesired component of the production fluid, such as water, steam, carbon dioxide, or natural gas, is entering one of the production intervals at greater than a target percentage, the fluid control apparatus in that interval will autonomously restrict production of formation fluid from that interval based on the density change when those components are present in greater than the targeted amount.

The fluid control apparatus actuates in response to density changes of the fluid in situ. The apparatus is designed to restrict fluid flow when the fluid reaches a target density. The density can be chosen to restrict flow of the fluid when it is reaches a target percentage of an undesirable component. For example, it may be desired to allow production of formation fluid where the fluid is composed of 80 percent oil (or more) with a corresponding composition of 20 percent (or less) of natural gas. Flow is restricted if the fluid falls below the target percentage of oil. Hence, the target density is production fluid density of a composition of 80 percent oil and 20 percent natural gas. If the fluid density becomes too low, flow is restricted by the mechanisms explained herein. Equivalently, an undesired higher density fluid could be restricted while a desired lower density fluid is produced.

Even though FIG. 1 depicts the fluid control assemblies of the present invention in an open hole environment, it should be understood by those skilled in the art that the invention is equally well suited for use in cased wells. Also, even though FIG. 1 depicts one fluid control apparatus in each production interval, it should be understood that any number of apparatus of the present invention can be deployed within a production interval without departing from the principles of the present invention.

Further, it is envisioned that the fluid control apparatus 25 can be used in conjunction with other downhole devices including inflow control devices (ICD) and screen assemblies. Inflow control devices and screen assemblies are not described here in detail, are known in the art, and are commercially available from Halliburton Energy Services, Inc. among others.

In addition, FIG. 1 depicts the fluid control apparatus of the present invention in a deviated section of the wellbore which is illustrated as a horizontal wellbore. It should be understood by those skilled in the art that the apparatus of the present invention are suited for use in deviated wellbores, including horizontal wellbores, as well as vertical wellbores. As used herein, deviated wellbores refer to wellbores which are intentionally drilled away from the vertical.

Figure 2:
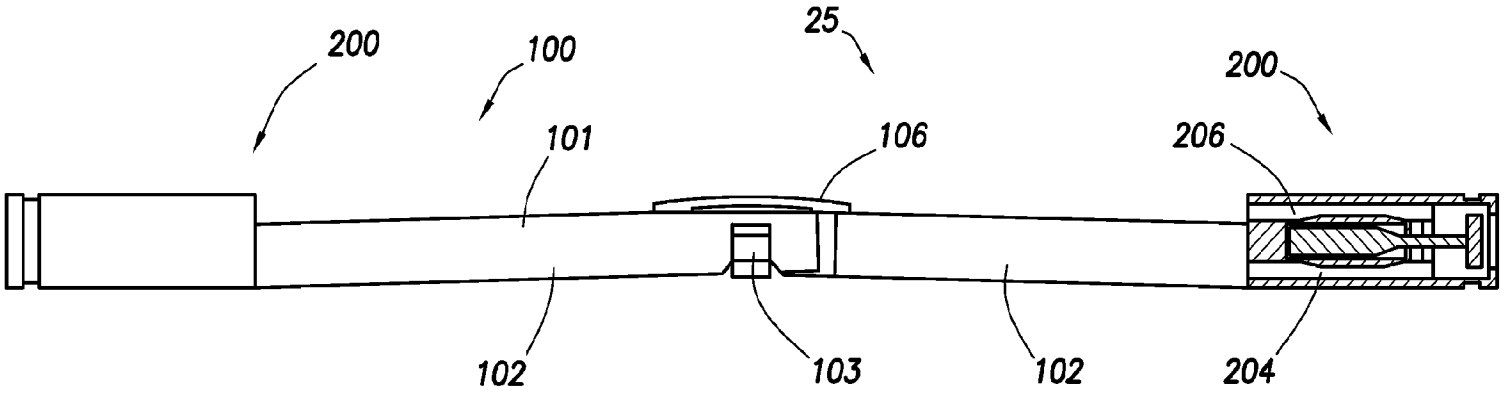
FIG. 2 is a side view in partial cross-section of one embodiment of the fluid control apparatus having pivoting diverter arms and in a higher density fluid according to one aspect of the invention.

FIG. 2 shows one embodiment of a fluid control apparatus 25 for controlling the flow of fluids in a downhole tubular. For purposes of discussion, the exemplary apparatus will be discussed as functioning to control production of formation fluid, restricting production of formation fluid with a greater proportion of natural gas. The flow control apparatus 25 is actuated by the change in formation fluid density. The fluid control apparatus 25 can be used along the length of a wellbore in a production string to provide fluid control at a plurality of locations. This can be advantageous, for example, to equalize production flow of oil in situations where a greater flow rate is expected at the heel of a horizontal well than at the toe of the well.

The fluid control apparatus 25 effectively restricts inflow of an undesired fluid while allowing minimally restricted flow of a desired fluid. For example, the fluid control apparatus 25 can be configured to restrict flow of formation fluid when the fluid is composed of a preselected percentage of natural gas, or where the formation fluid density is lower than a target density. In such a case, the fluid control apparatus selects oil production over gas production, effectively restricting gas production.

FIG. 2 is a side view in partial cross-section of one embodiment of the fluid control apparatus 25 for use in an oilfield tubular positioned in a wellbore extending through a subterranean formation. The fluid control apparatus 25 includes two valve assemblies 200 and fluid diverter assembly 100. The fluid diverter assembly 100 has a fluid diverter 101 with two diverter arms 102. The diverter arms 102 are connected to one another and pivot about a pivoting joint 103. The diverter 101 is manufactured from a substance of a density selected to actuate the diverter arms 102 when the downhole fluid reaches a preselected density. The diverter can be made of plastic, rubber, composite material, metal, other material, or a combination of these materials.

The fluid diverter arms 102 are used to select how fluid flow is split between lower inlet 204 and upper inlet 206 of the valve assembly 200 and hence to control fluid flow through the tubular. The fluid diverter 101 is actuated by change in the density of the fluid in which it is immersed and the corresponding change in the buoyancy of the diverter 101. When the density of the diverter 101 is higher than the fluid, the diverter will "sink" to the position shown in FIG. 2, referred to as the closed position since the valve assembly 200 is closed (restricting flow) when the diverter arms 102 are in this position. In the closed position, the diverter arms 102 pivot downward positioning the ends of the arms 102 proximate to inlet 204. If the formation fluid density increases to a density higher than that of the diverter 101, the change will actuate the diverter 101, causing it to "float" and moving the diverter 101 to the position shown in FIG. 3. The fluid control apparatus is in an open position in FIG. 3 since the valve assembly 200 is open when the diverter arms are in the position shown.

The fluid diverting arms operate on the difference in the density of the downhole fluid over time. For example, the buoyancy of the diverter arms is different in a fluid composed primarily of oil versus a fluid primarily composed of natural gas. Similarly, the buoyancy changes in oil versus water, water versus gas, etc. The buoyancy principles are explained more fully herein with respect to FIGS. 15-20. The arms will move between the open and closed positions in response to the changing fluid density. In the embodiment seen in FIG. 2, the diverter 101 material is of a higher density than the typical downhole fluid and will remain in the position shown in FIG. 2 regardless of the fluid density. In such a case, a biasing mechanism 106 can be used, here shown as a leaf spring, to offset gravitational effects such that the diverter arms 102 will move to the open position even though the diverter arms are denser than the downhole fluid, such as oil. Other biasing mechanisms as are known in the art may be employed such as, but not limited to, counterweights, other spring types, etc., and the biasing mechanisms can be positioned in other locations, such as at or near the ends of the diverter arms. Here, the biasing spring 106 is connected to the two diverter arms 102, tending to pivot them upwards and towards the position seen in FIG. 3. The biasing mechanism and the force it exerts are selected such that the diverter arms 102 will move to the position seen in FIG. 3 when the fluid reaches a preselected density. The density of the diverter arms and the force of the biasing spring are selected to result in actuation of the diverter arms when the fluid in which the apparatus is immersed reaches a preselected density.

Figure 4:
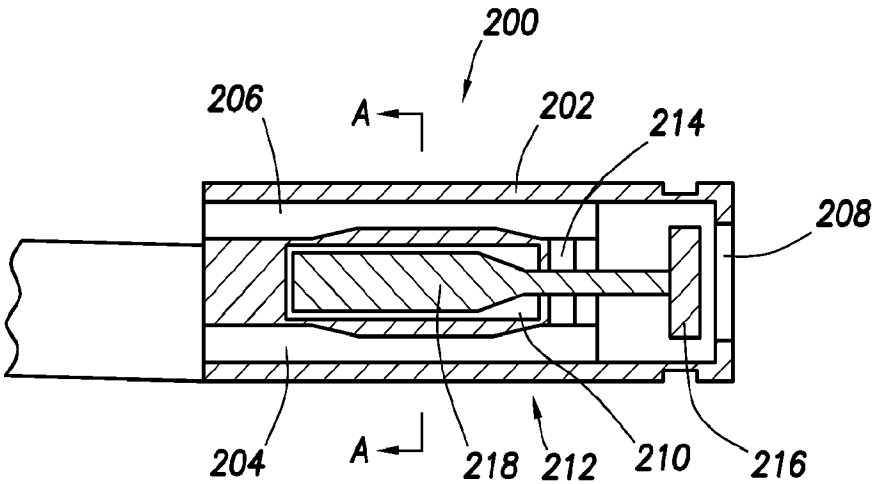
FIG. 4 is a detail side cross-sectional view of an exemplary fluid valve assembly according to one aspect of the invention.

The valve assembly 200 seen in FIG. 2 is shown in detail in the cross-sectional view in FIG. 4. The valve assembly shown is exemplary in nature and the details and configuration of the valve can be altered without departing from the spirit of the invention. The valve assembly 200 has a valve housing 202 with a lower inlet 204, an upper inlet 206, and an outlet 208. The valve chamber 210 contains a valve member 212 operable to restrict fluid flow through the outlet 208. An example valve member 212 comprises a pressure-activated end or arm 218 and a stopper end or arm 216 for restricting flow through outlet 208. The valve member 212 is mounted in the valve housing 202 to rotate about pivot 214. In the closed position, the stopper end 216 of the valve member is proximate to and restricts fluid flow through the outlet 208. The stopper end can restrict or stop flow.

The exemplary valve assembly 200 includes a venturi pressure converter to enhance the driving pressure of the valve assembly. Based on Bernoulli's principle, assuming other properties of the flow remain constant, the static pressure will decrease as the flow velocity increases. A fluid flow ratio is created between the two inlets 204 and 206 by using the diverter arms 102 to restrict flow through one of the fluid inlets of the valve assembly, thereby reducing volumetric fluid flow through that inlet. The inlets 204 and 206 have venturi constrictions therein to enhance the pressure change at each pressure port 224 and 226. The venturi pressure converter allows the valve to have a small pressure differential at the inlets but a larger pressure differential can be used to open and close the valve assembly 200.

Figure 5:
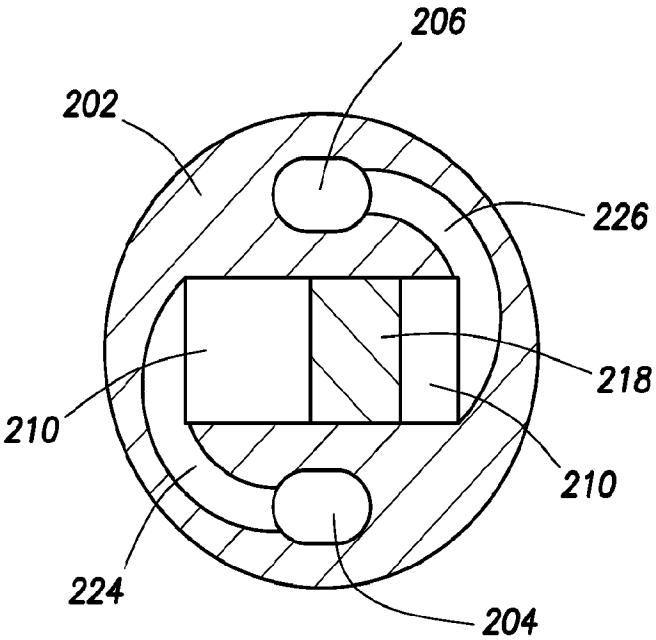
FIG. 5 is an end view taken along line A-A of FIG. 4.

FIG. 5 is an end view in cross-section taken along line A-A of FIG. 4. Pressure ports 224 and 226 are seen in the cross-sectional view. Upper pressure port 226 communicates fluid pressure from upper inlet 206 to one side of the valve chamber 210. Similarly, lower pressure port 224 communicates pressure as measured at the lower inlet 204 to the opposite side of the valve chamber 210. The difference in pressure actuates the pressure-activated arm 218 of the valve member 212. The pressure-activated arm 218 will be pushed by the higher pressure side, or suctioned by the lower pressure side, and pivot accordingly.

Figure 3:
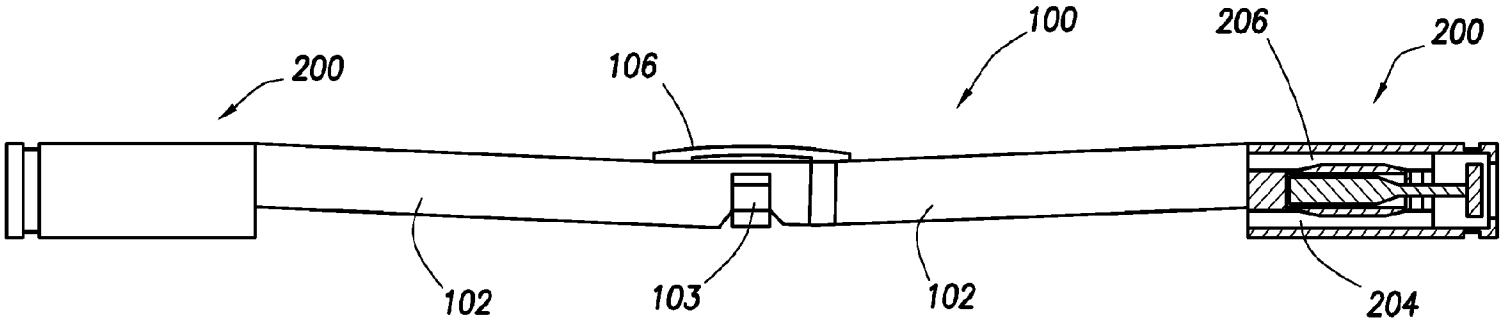
FIG. 3 is a side view in partial cross-section of one embodiment of the fluid control apparatus having pivoting diverter arms and in a lower density fluid according to one aspect of the invention.
Figure 6:
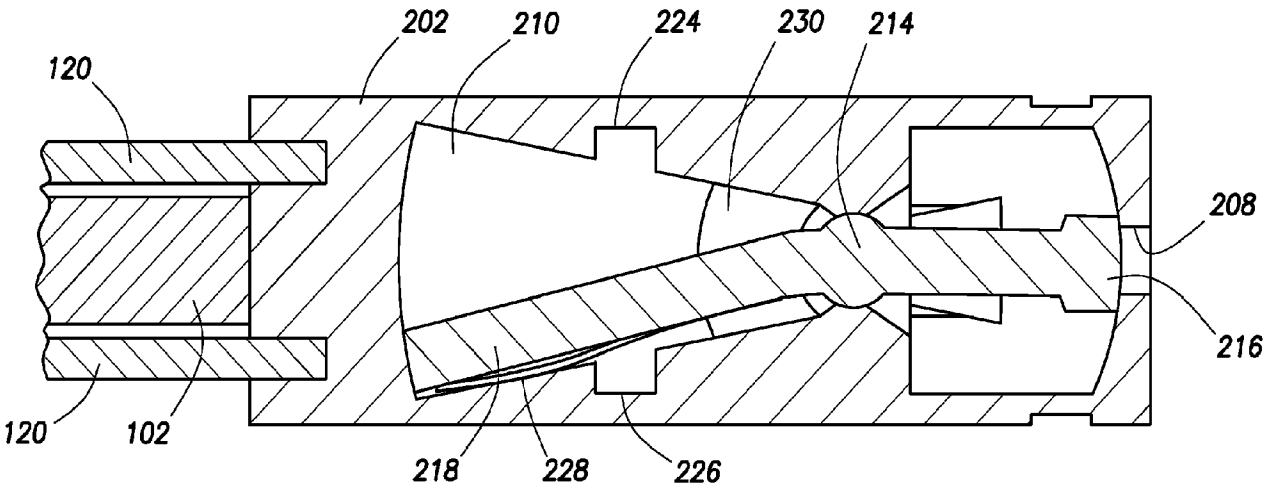
FIG. 6 is a bottom view in cross-section of the valve assembly of FIG. 2 with the valve member in the closed position (the apparatus in fluid of a relatively high density)
Figure 7:
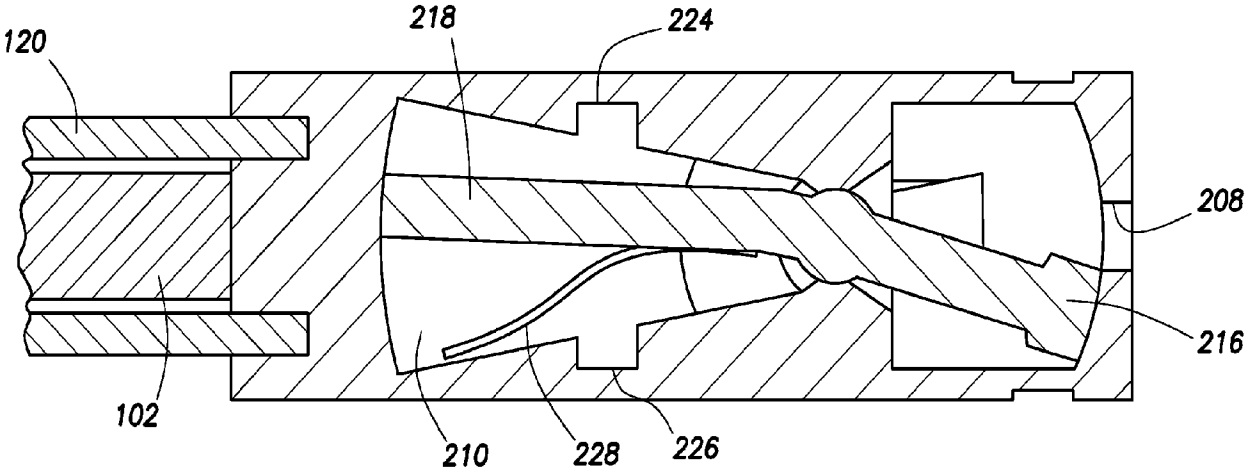
FIG. 7 is a bottom view in cross-section of the valve assembly of FIG. 3 with the valve member in the open position (the apparatus in fluid of a relatively low density)

FIGS. 6 and 7 are bottom views in cross-section of the valve assembly seen in FIGS. 2 and 3. FIG. 6 shows the valve assembly in a closed position with the fluid diverter arms 102 in the corresponding closed position as seen in FIG. 2. The diverter arm 102 is positioned to restrict fluid flow into lower inlet 204 of the valve assembly 200. A relatively larger flow rate is realized in the upper inlet 206. The difference in flow rate and resultant difference in fluid pressure is used, via pressure ports 224 and 226, to actuate pressure-activated arm 218 of valve member 212. When the diverter arm 102 is in the closed position, it restricts the fluid flow into the lower inlet 204 and allows relatively greater flow in the upper inlet 206. A relatively lower pressure is thereby conveyed through the upper pressure port 226 while a relatively greater pressure is conveyed through the lower pressure port 224. The pressure-activated arm 218 is actuated by this pressure difference and pulled toward the low pressure side of the valve chamber 210 to the closed position seen in FIG. 6. The valve member 212 rotates about pivot 214 and the stopper end 216 of the valve member 212 is moved proximate the outlet 208, thereby restricting fluid flow through the valve assembly 200. In a production well, the formation fluid flowing from the formation and into the valve assembly is thereby restricted from flowing into the production string and to the surface.

A biasing mechanism 228, such as a spring or a counterweight, can be employed to bias the valve member 212 towards one position. As shown, the leaf spring biases the member 212 towards the open position as seen in FIG. 7. Other devices may be employed in the valve assembly, such as the diaphragm 230 to control or prevent fluid flow or pressure from acting on portions of the valve assembly or to control or prevent fines from interfering with the movement of the pivot, 214. Further, alternate embodiments will be readily apparent to those of skill in the art for the valve assembly. For example, bellows, pressure balloons, and alternate valve member designs can be employed.

FIG. 7 is a bottom cross-section view of the valve assembly 200 seen in an open position corresponding to FIG. 3. In FIG. 7, the diverter arm 102 is in an open position with the diverter arm 102 proximate the upper inlet 206 and restricting fluid flow into the upper inlet. A greater flow rate is realized in the lower inlet 204. The resulting pressure difference in the inlets, as measured through pressure ports 224 and 226, results in actuation and movement of the valve member 212 to the open position. The pressure-activated arm of the member 212 is pulled towards the pressure port 224, pivoting the valve member 212 and moving the stopper end 216 away from the outlet 208. Fluid flows freely through the valve assembly 200 and into the production string and to the surface.

Figure 8:
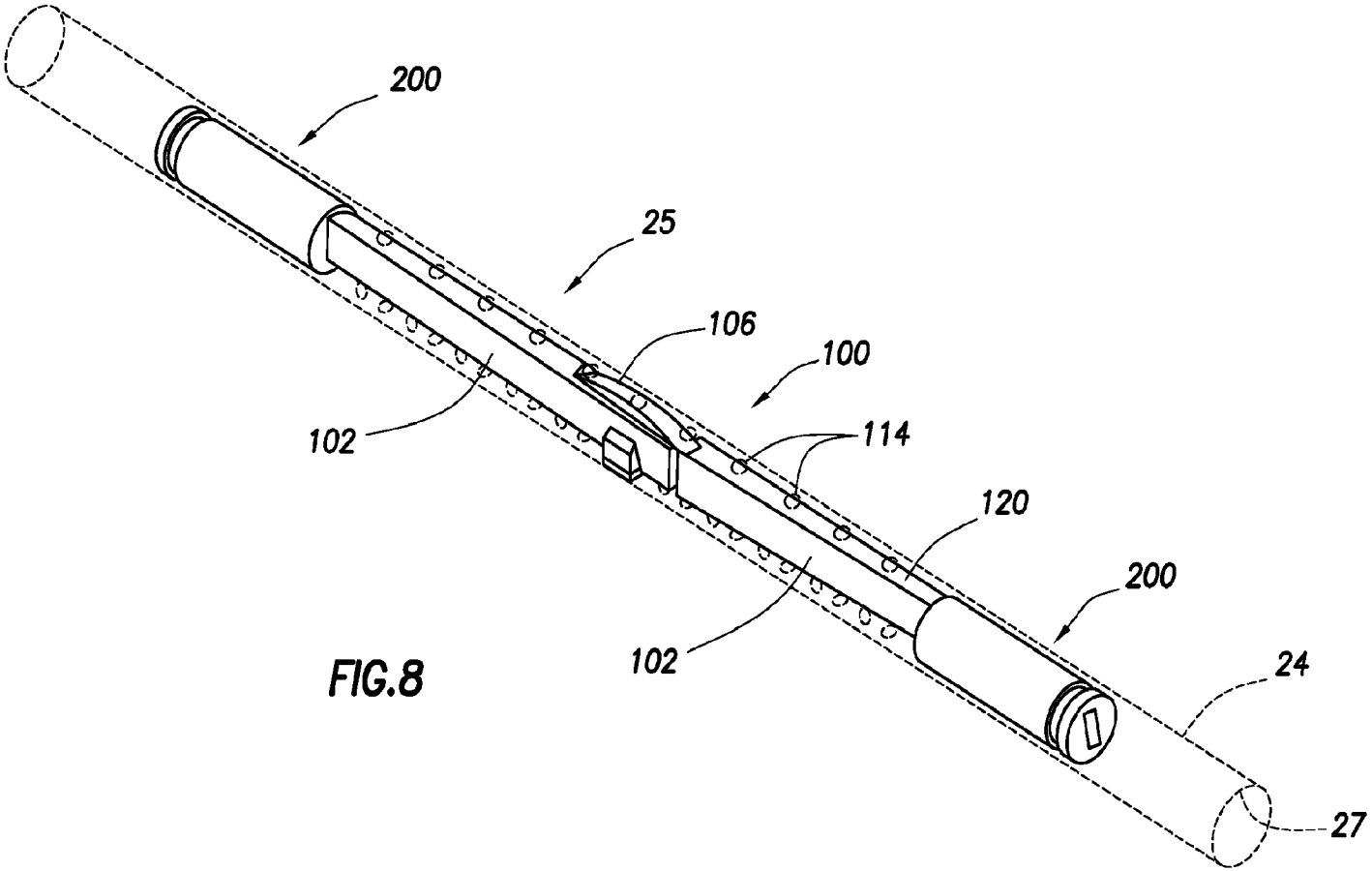
FIG. 8 is an orthogonal view of a fluid flow control apparatus having the diverter configuration according to FIG. 2.

FIG. 8 is an orthogonal view of a fluid control assembly 25 in a housing 120 and connected to a production tubing string 24. In this embodiment, the housing 120 is a downhole tubular with openings 114 for allowing fluid flow into the interior opening of the housing. Formation fluid flows from the formation into the wellbore and then through the openings 114. The density of the formation fluid determines the behavior and actuation of the fluid diverter arms 102. Formation fluid then flows into the valve assemblies 200 on either end of the assembly 25. Fluid flows from the fluid control apparatus to the interior passageway 27 that leads towards the interior of the production tubing, not shown. In the preferred embodiment seen in FIGS. 2-8, the fluid control assembly has a valve assembly 200 at each end. Formation fluid flowing through the assemblies can be routed into the production string, or formation fluid from the downstream end can be flowed elsewhere, such as back into the wellbore.

The dual-arm and dual valve assembly design seen in the figures can be replaced with a single arm and single valve assembly design. An alternate housing 120 is seen in FIGS. 6 and 7 where the housing comprises a plurality of rods connecting the two valve assembly housings 202.

Note that the embodiment as seen in FIGS. 2-8 can be modified to restrict production of various fluids as the composition and density of the fluid changes. For example, the embodiment can be designed to restrict water production while allowing oil production, restrict oil production while allowing natural gas production, restrict water production while allowing natural gas production, etc. The valve assembly can be designed such that the valve is open when the diverter is in a "floating," buoyant or upper position, as seen in FIG. 3, or can be designed to be open where the diverter is in a "sunk" or lower position, as seen in FIG. 2, depending on the application. For example, to select natural gas production over water production, the valve assembly is designed to be closed when the diverter rises due to its buoyancy in the relatively higher density of water, to the position seen in FIG. 3.

Further, the embodiment can be employed in processes other than production from a hydrocarbon well. For example, the device can be utilized during injection of fluids into a wellbore to select injection of steam over water based on the relative densities of these fluids. During the injection process, hot water and steam are often commingled and exist in varying ratios in the injection fluid. Often hot water is circulated downhole until the wellbore has reached the desired temperature and pressure conditions to provide primarily steam for injection into the formation. It is typically not desirable to inject hot water into the formation. Consequently, the flow control apparatus 25 can be utilized to select for injection of steam (or other injection fluid) over injection of hot water or other less desirable fluids. The diverter will actuate based on the relative density of the injection fluid. When the injection fluid has an undesirable proportion of water and a consequently relatively higher density, the diverter will float to the position seen in FIG. 3, thereby restricting injection fluid flow into the upper inlet 206 of the valve assembly 200. The resulting pressure differential between the upper and lower inlets 204 and 206 is utilized to move the valve assembly to a closed position, thereby restricting flow of the undesired fluid through the outlet 208 and the formation. As the injection fluid changes to a higher proportion of steam, with a consequent change to a lower density, the diverter will move to the opposite position, thereby reducing the restriction on the fluid to the formation. The injection methods described above are described for steam injection. It is to be understood that carbon dioxide or other injection fluid can be utilized.

Figure 9:
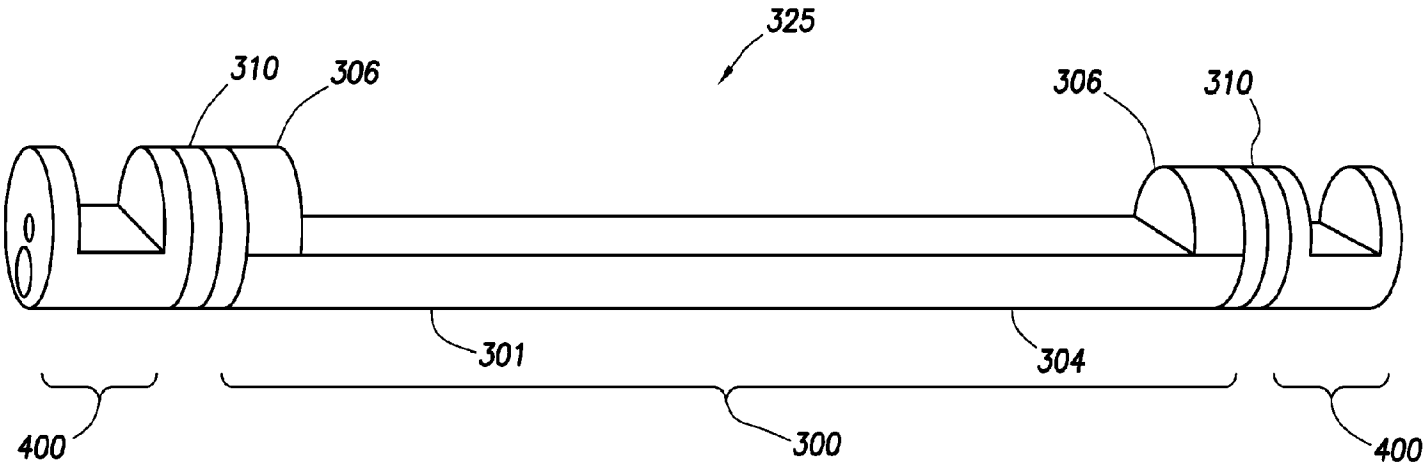
FIG. 9 is an elevational view of another embodiment of the fluid control apparatus having a rotating diverter according to one aspect of the invention.

FIG. 9 is an elevation view of another embodiment of a fluid control apparatus 325 having a rotating diverter 301. The fluid control assembly 325 includes a fluid diverter assembly 300 with a movable fluid diverter 301 and two valve assemblies 400 at either end of the diverter assembly.

The diverter 301 is mounted for rotational movement in response to changes in fluid density. The exemplary diverter 301 shown is semi-circular in cross-section along a majority of its length with circular cross-sectional portions at either end. The embodiment will be described for use in selecting production of a higher density fluid, such as oil, and restricting production of a relatively lower density fluid, such as natural gas. In such a case, the diverter is "weighted" by high density counterweight portions 306 made of material with relatively high density, such as steel or another metal. The portion 304, shown in an exemplary embodiment as semi-circular in cross section, is made of a material of relatively lower density material, such as plastic. The diverter portion 304 is more buoyant than the counterweight portions 306 in denser fluid, causing the diverter to rotate to the upper or open position seen in FIG. 10. Conversely, in a fluid of relatively lower density, such as natural gas, the diverter portion 304 is less buoyant than the counterweight portions 306, and the diverter 301 rotates to a closed position as seen in FIG. 9. A biasing element, such as a spring-based biasing element, can be used instead of the counterweight.

Figure 10:
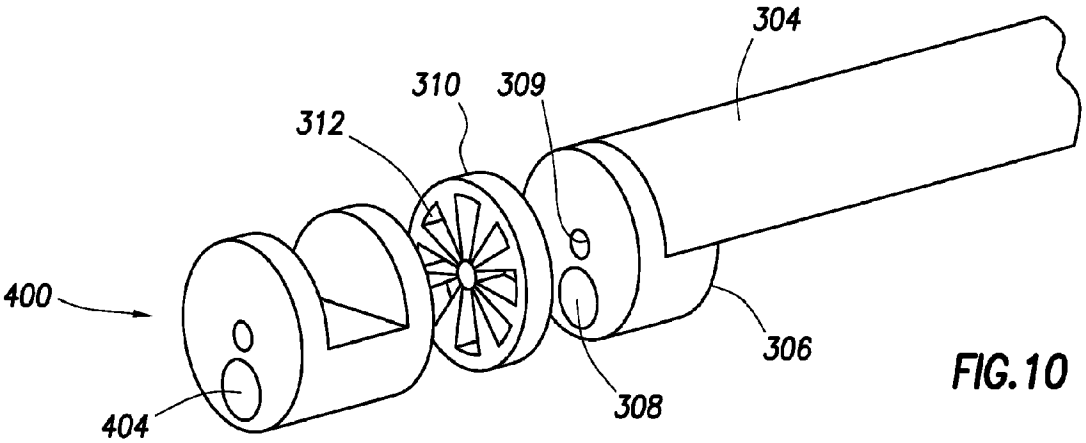
FIG. 10 is an exploded view of the fluid control apparatus of FIG. 9.

FIG. 10 is an exploded detail view of the fluid control assembly of FIG. 9. In FIG. 10, the fluid selector or diverter 301 is rotated into an open position, such as when the assembly is immersed in a fluid with a relatively high density, such as oil. In a higher density fluid, the lower density portion 304 of the diverter 301 is more buoyant and tends to "float." The lower density portion 304 may be of a lower density than the fluid in such a case. However, it is not required that the lower density portion 304 be less dense than the fluid. Instead, the high density portions 306 of the diverter 301 can serve as a counterweight or biasing member.

The diverter 301 rotates about its longitudinal axis 309 to the open position as seen in FIG. 10. When in the open position, the diverter passageway 308 is aligned with the outlet 408, best seen in FIG. 12, of the valve assembly 400. In this case, the valve assembly 400 has only a single inlet 404 and outlet 408. In the preferred embodiment shown, the assembly 325 further includes fixed support members 310 with multiple ports 312 to facilitate fluid flow through the fixed support.

As seen in FIGS. 9-13, the fluid valve assemblies 400 are located at each end of the assembly. The valve assemblies have a single passageway defined therein with inlet 404 and outlet 408. The outlet 408 aligns with the passageway 308 in the diverter 301 when the diverter is in the open position, as seen in FIG. 10. Note that the diverter 301 design seen in FIGS. 9-10 can be employed, with modifications which will be apparent to one of skill in the art, with the venturi pressure valve assembly 200 seen in FIGS. 2-7. Similarly, the diverter arm design seen in FIG. 2 can, with modification, be employed with the valve assembly seen in FIG. 9.

Figure 13:
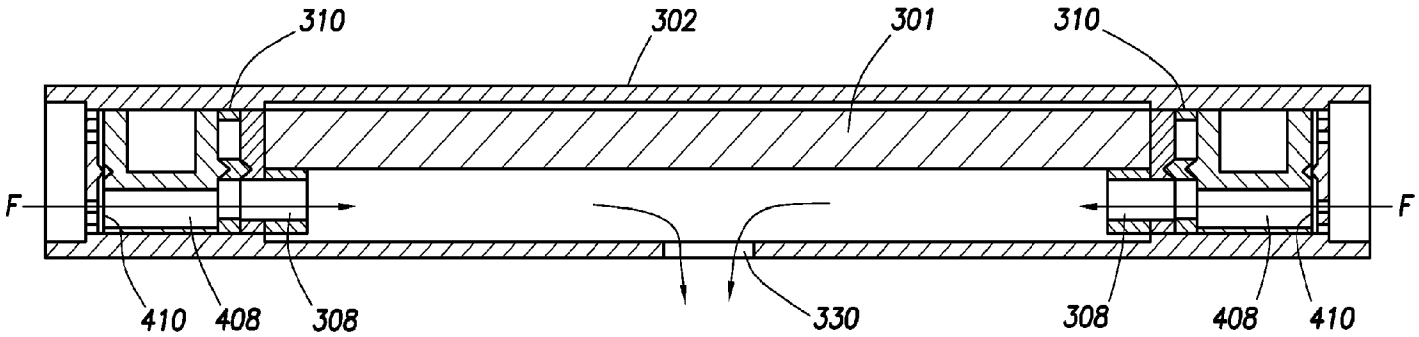
FIG. 13 is a side cross-sectional view of the fluid control apparatus of FIG. 9 with the apparatus in fluid of a higher density.

The buoyancy of the diverter creates a torque which rotates the diverter 301 about its longitudinal rotational axis. The torque produced must overcome any frictional and inertial forces tending to hold the diverter in place. Note that physical constraints or stops can be employed to constrain rotational movement of the diverter; that is, to limit rotation to various angles of rotation within a preselected arc or range. The torque will then exceed the static frictional forces to ensure the diverter will move when desired. Further, the constraints can be placed to prevent rotation of the diverter to top or bottom center to prevent possibly getting "stuck" in such an orientation. In one embodiment, the restriction of fluid flow is directly related to the angle of rotation of the diverter within a selected range of rotation. The passageway 308 of the diverter 301 aligns with the outlet 408 of the valve assembly when the diverter is in a completely open position, as seen in FIGS. 10 and 13. The alignment is partial as the diverter rotates towards the open position, allowing greater flow as the diverter rotates into the fully open position. The degree of flow is directly related to the angle of rotation of the diverter when the diverter rotates between partial and complete alignment with the valve outlet.

Figure 11:
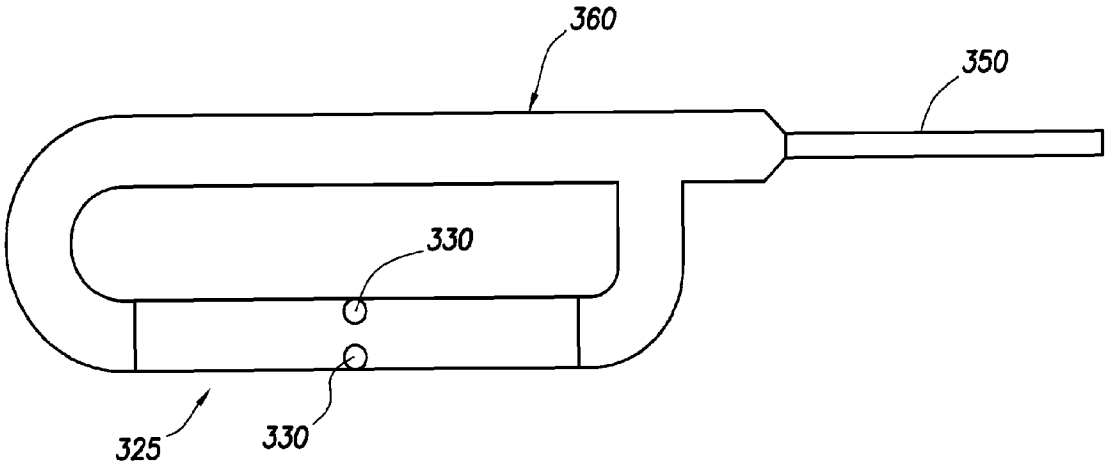
FIG. 11 is a schematic flow diagram having an end of flow control device used in conjunction with the fluid control apparatus according to one aspect of the invention.

FIG. 11 is a flow schematic of one embodiment of the invention. An inflow control device 350, or ICD, is in fluid communication with the fluid control assembly 325. Fluid flows through the inflow control device 300, through the flow splitter 360 to either end of the fluid control apparatus 325 and then through the exit ports 330. Alternately, the system can be run with the entrance in the center of the fluid control device and the outlets at either end.

Figure 12:
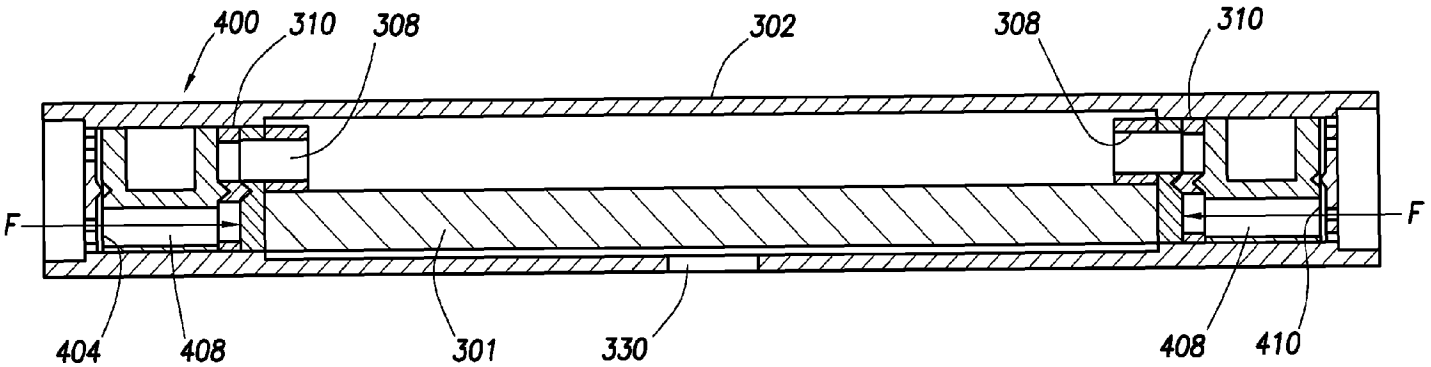
FIG. 12 is a side cross-sectional view of the fluid control apparatus of FIG. 9 with the diverter shown in the closed position with the apparatus in the fluid of lower density.

FIG. 12 is a side view in cross-section of the fluid control apparatus 325 embodiment seen in FIG. 9 with the diverter 301 in the closed position. A housing 302 has within its interior the diverter assembly 300 and valve assemblies 400. The housing includes outlet port 330. In FIG. 12, the formation fluid F flows into each valve assembly 400 by inlet 404. Fluid is prevented or restricted from exiting by outlet 408 by the diverter 301.

The diverter assembly 300 is in a closed position in FIG. 12. The diverter 301 is rotated to the closed position as the density of the fluid changes to a denser composition due to the relative densities and buoyancies of the diverter portions 304 and 306. The diverter portion 304 can be denser than the fluid, even where the fluid changes to a denser composition (and whether in the open or closed position) and in the preferred embodiment is denser than the fluid at all times. In such a case, where the diverter portion 304 is denser than the fluid even when the fluid density changes to a denser composition, counterweight portions 306 are utilized. The material in the diverter portion 304 and the material in the counterweight portion 306 have different densities. When immersed in fluid, the effective density of the portions is the actual density of the portions minus the fluid density. The volume and density of the diverter portion 304 and the counterweight portions 306 are selected such that the relative densities and relative buoyancies cause the diverter portion 304 to "sink" and the counterweight portion to "sink" in the fluid when it is of a low density (such as when comprised of natural gas). Conversely, when the fluid changes to a higher density, the diverter portion 304 "rises" or "floats" in the fluid and the counterweight portions "sink" (such as in oil). As used herein, the terms "sink" and "float" are used to describe how that part of the system moves and does not necessitate that the part be of greater weight or density than the actuating fluid.

In the closed position, as seen in FIGS. 9 and 12, the passageway 308 through the diverter portion 306 does not align with the outlet 408 of the valve assembly 400. Fluid is restricted from flowing through the system. Note that it is acceptable in many instances for some fluid to "leak" or flow in small amounts through the system and out through exit port 330.

FIG. 13 is a side view in cross-section of the fluid control apparatus as in FIG. 12, however, the diverter 301 is rotated to the open position. In the open position, the outlet 408 of the valve assembly is in alignment with the passageway 308 of the diverter. Fluid F flows from the formation into the interior passageway of the tubular having the apparatus. Fluid enters the valve assembly 400, flows through portal 312 in the fixed support 310, through the passageway 308 in the diverter, and then exits the housing through port or ports 330. The fluid is then directed into production tubing and to the surface. Where oil production is selected over natural gas production, the diverter 301 rotates to the open position when the fluid density in the wellbore reaches a preselected density, such as the expected density of formation oil. The apparatus is designed to receive fluid from both ends simultaneously to balance pressure to both sides of the apparatus and reduce frictional forces during rotation. In an alternate embodiment, the apparatus is designed to allow flow from a single end or from the center outward.

Figure 15:
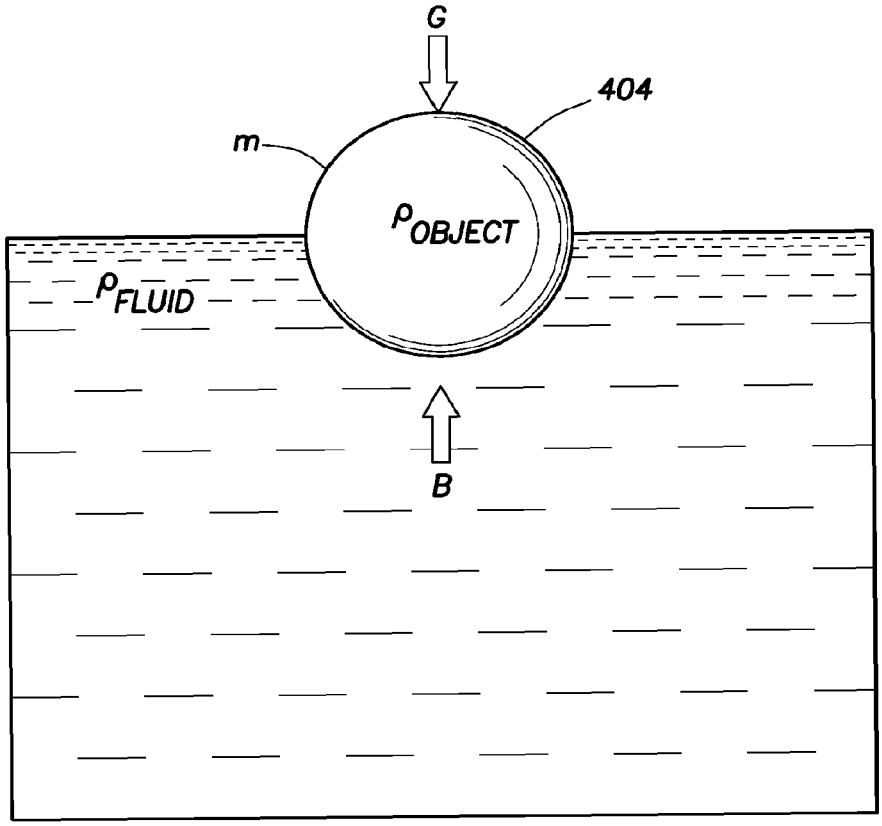
FIG. 15 is a schematic illustrating the principles of buoyancy.

FIG. 15 is a schematic illustrating the principles of buoyancy. Archimedes' principle states that an object wholly or partly immersed in a fluid is buoyed by a force equal to the weight of the fluid displaced by the object. Buoyancy reduces the relative weight of the immersed object. Gravity G acts on the object 404. The object has a mass, m, and a density, ρ-object. The fluid has a density, ρ-fluid. Buoyancy, B, acts upward on the object. The relative weight of the object changes with buoyancy. Consider a plastic having a relative density (in air) of 1.1. Natural gas has a relative density of approximately 0.3, oil of approximately 0.8, and water of approximately 1.0. The same plastic has a relative density of 0.8 in natural gas, 0.3 in oil, and 0.1 in water. Steel has a relative density of 7.8 in air, 7.5 in oil and 7.0 in water.

Figure 16:
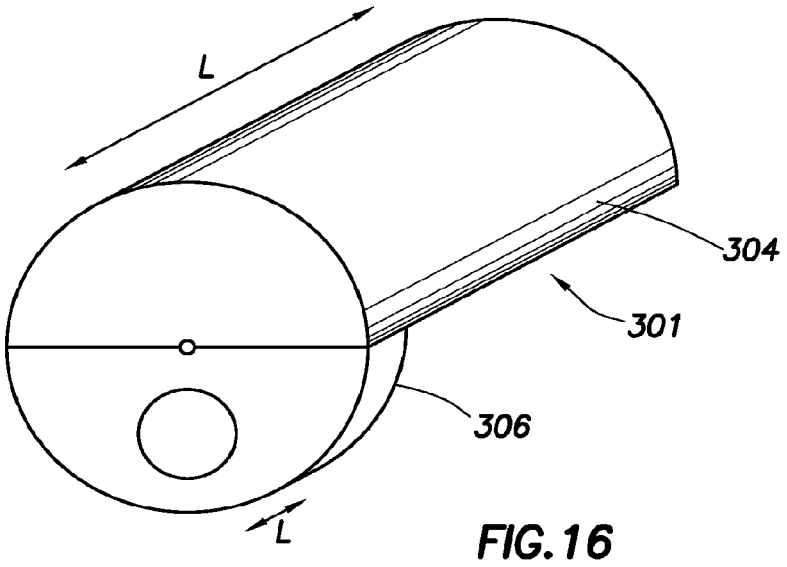
FIG. 16 is a schematic drawing illustrating the effect of buoyancy on objects of differing density and volume immersed in the fluid air.
Figure 17:
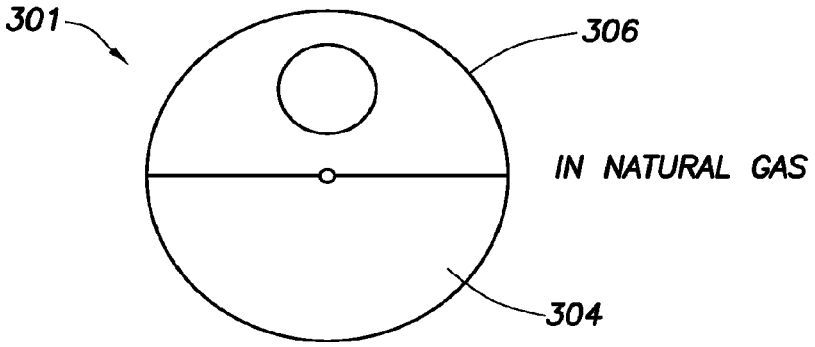
FIG. 17 is a schematic drawing illustrating the effect of buoyancy on objects of differing density and volume immersed in the fluid natural gas.
Figure 18:
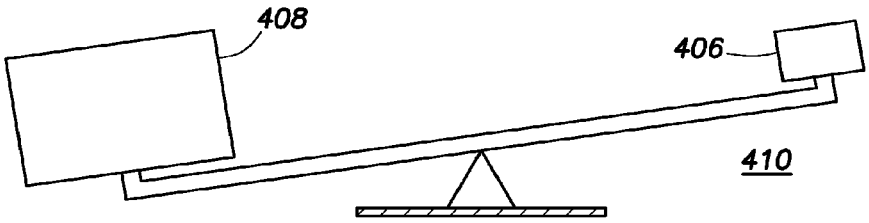
FIG. 18 is a schematic drawing illustrating the effect of buoyancy on objects of differing density and volume immersed in the fluid oil.

FIGS. 16-18 are schematic drawings showing the effect of buoyancy on objects of differing density and volume immersed in different fluids. Continuing with the example, placing plastic and steel objects on a balance illustrates the effects of buoyancy. The steel object 406 has a relative volume of one, while the plastic object 408 has a relative volume of 13. In FIG. 16, the plastic object 408 has a relative weight in air 410 of 14.3 while the steel object has a relative weight of 7.8. Thus, the plastic object is relatively heavier and causes the balance to lower on the side with the plastic object. When the balance and objects are immersed in natural gas 412, as in FIG. 17, the balance remains in the same position. The relative weight of the plastic object is now 10.4 while the relative weight of the steel object is 7.5 in natural gas. In FIG. 18, the system is immersed in oil 414. The steel object now has a relative weight of 7.0 while the plastic object has a relative weight of 3.9 in oil. Hence, the balance now moves to the position as shown because the plastic object 408 is more buoyant than the steel object 406.

Figure 19:
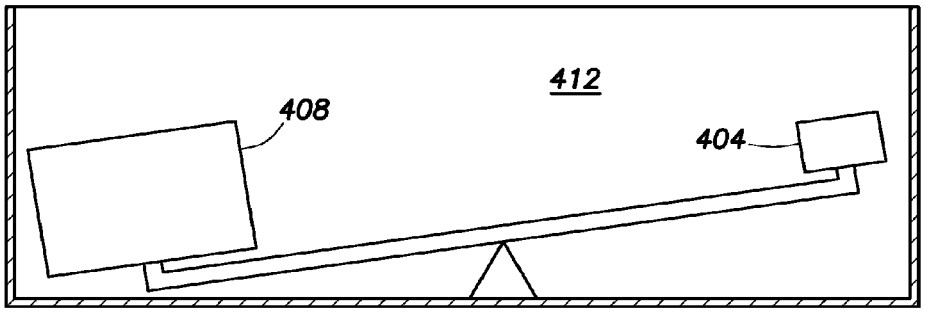
FIG. 19 is a schematic drawing of one embodiment of the invention illustrating the relative buoyancy and positions in fluids of different relative density.
Figure 20:
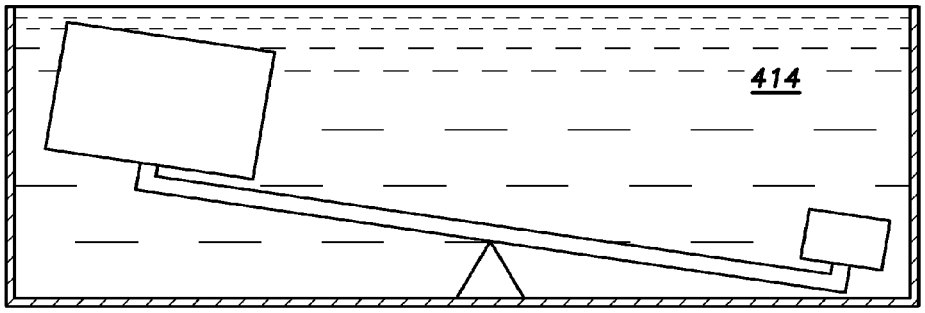
FIG. 20 is a schematic drawing of one embodiment of the invention illustrating the relative buoyancy and positions in fluids of different relative density.

FIGS. 19 and 20 are schematic drawings of the diverter 301 illustrating the relative buoyancy and positions of the diverter in fluids of different relative density. Using the same plastic and steel examples as above and applying the principals to the diverter 301, the steel counterweight portion 306 has a length L of one unit and the plastic diverter portion 304 has a length L of 13 units. The two portions are both hemicylindrical and have the same cross-section. Hence the plastic diverter portion 304 has 13 times the volume of the counterweight portion 306. In oil or water, the steel counterweight portion 306 has a greater actual weight and the diverter 301 rotates to the position seen in FIG. 19. In air or natural gas, the plastic diverter portion 304 has a greater actual weight and the diverter 301 rotates to the lower position seen in FIG. 20. These principles are used in designing the diverter 301 to rotate to selected positions when immersed in fluid of known relative densities. The above is merely an example and can be modified to allow the diverter to change position in fluids of any selected density.

Figure 14:
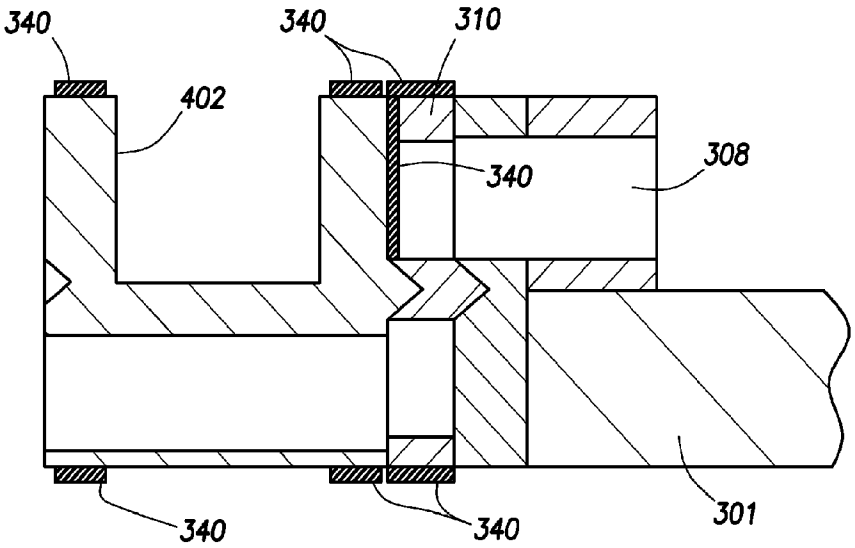
FIG. 14 is a detail side view in cross-section of the fluid control apparatus of FIG. 9.

FIG. 14 is a side cross-sectional view of one end of the fluid control assembly 325 as seen in FIG. 9. Since the operation of the assembly is dependent on the movement of the diverter 301 in response to fluid density, the valve assemblies 400 need to be oriented in the wellbore. A preferred method of orienting the assemblies is to provide a self-orienting valve assembly which is weighted to cause rotation of the assembly in the wellbore. The self-orienting valve assembly is referred to as a "gravity selector."

Once properly oriented, the valve assembly 400 and fixed support 310 can be sealed into place to prevent further movement of the valve assembly and to reduce possible leak pathways. In a preferred embodiment, as seen in FIG. 14, a sealing agent 340 has been placed around the exterior surfaces of the fixed support 310 and valve assembly 400. Such an agent can be a swellable elastomer, an o-ring, an adhesive or epoxy that bonds when exposed to time, temperature, or fluids for example. The sealing agent 340 may also be placed between various parts of the apparatus which do not need to move relative to one another during operation, such as between the valve assembly 400 and fixed support 310 as shown. Preventing leak paths can be important as leaks can potentially reduce the effectiveness of the apparatus greatly. The sealing agent should not be placed to interfere with rotation of the diverter 301.

The fluid control apparatus described above can be configured to select oil production over water production based on the relative densities of the two fluids. In a gas well, the fluid control apparatus can be configured to select gas production over oil or water production. The invention described herein can also be used in injection methods. The fluid control assembly is reversed in orientation such that flow of injection fluid from the surface enters the assembly prior to entering the formation. In an injection operation, the control assembly operates to restrict flow of an undesired fluid, such as water, while not providing increased resistance to flow of a desired fluid, such as steam or carbon dioxide. The fluid control apparatus described herein can also be used on other well operations, such as work-overs, cementing, reverse cementing, gravel packing, hydraulic fracturing, etc. Other uses will be apparent to those skilled in the art.

Figures 21, 22:
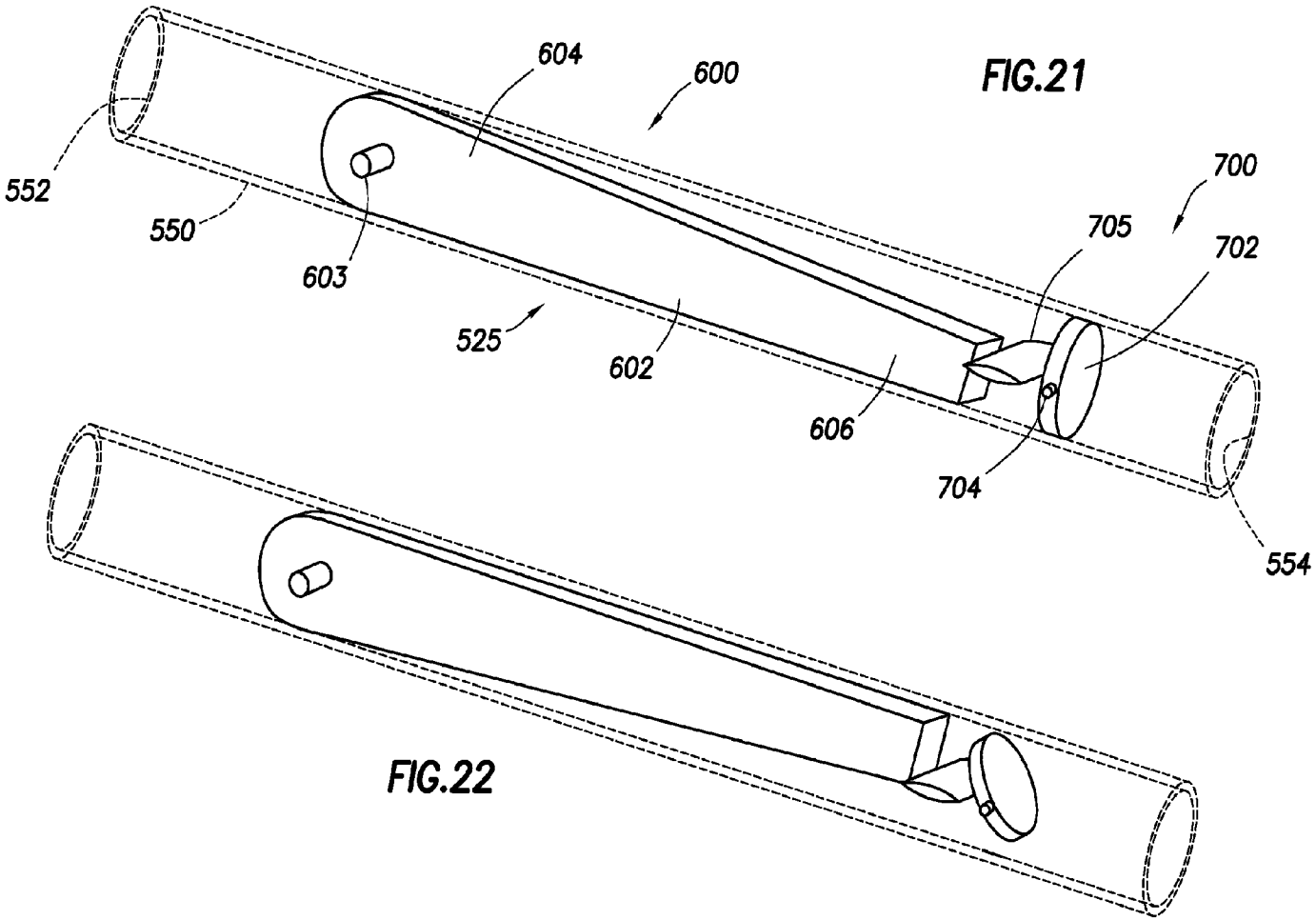
FIG. 21 is an elevational view of another embodiment of the fluid control apparatus having a rotating diverter that changes the flow direction according to one aspect of the invention.
FIG. 22 shows the apparatus of FIG. 21 in the position where the fluid flow is minimally restricted.
Figure 23:
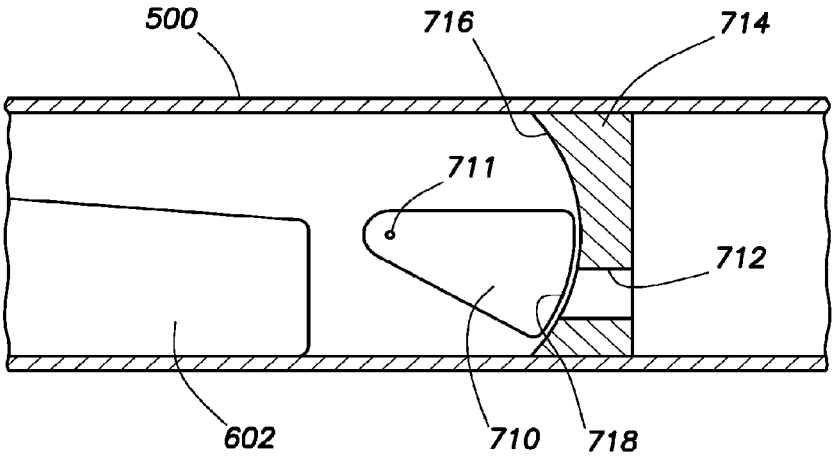
FIGS. 23 through 26 are side cross-sectional views of the closing mechanism in FIG. 21.

FIGS. 21 and 22 are orthogonal views of another embodiment of a fluid flow control apparatus of the invention having a pivoting diverter arm and valve assembly. The fluid control apparatus 525 has a diverter assembly 600 and valve assembly 700 positioned in a tubular 550. The tubular 550 has an inlet 552 and outlet 554 for allowing fluid flow through the tubular. The diverter assembly 600 includes a diverter arm 602 which rotates about pivot 603 between a closed position, seen in FIG. 21, and an open position, seen in FIG. 22. The diverter arm 602 is actuated by change in the density of the fluid in which it is immersed. Similar to the descriptions above, the diverter arm 602 has less buoyancy when the fluid flowing through the tubular 550 is of a relatively low density and moves to the closed position. As the fluid changes to a relatively higher density, the buoyancy of the diverter arm 602 increases and the arm is actuated, moving upward to the open position. The pivot end 604 of the diverter arm has a relatively narrow cross-section, allowing fluid flow on either side of the arm. The free end 606 of the diverter arm 602 is preferably of a substantially rectangular cross-section which restricts flow through a portion of the tubular. For example, the free end 606 of the diverter arm 602, as seen in FIG. 15, restricts fluid flow along the bottom of the tubular, while in FIG. 22 flow is restricted along the upper portion of the tubular. The free end of the diverter arm does not entirely block flow through the tubular.

The valve assembly 700 includes a rotating valve member 702 mounted pivotally in the tubular 550 and movable between a closed position, seen in FIG. 15, wherein fluid flow through the tubular is restricted, and an open position, seen in FIG. 22, wherein the fluid is allowed to flow with less restriction through the valve assembly. The valve member 702 rotates about pivot 704. The valve assembly can be designed to partially or completely restrict fluid flow when in the closed position. A stationary flow arm 705 can be utilized to further control fluid flow patterns through the tubular.

Movement of the diverter arm 602 affects the fluid flow pattern through the tubular 550. When the diverter arm 602 is in the lower or closed position, seen in FIG. 15, fluid flowing through the tubular is directed primarily along the upper portion of the tubular. Alternately, when the diverter arm 602 is in the upper or open position, seen in FIG. 22, fluid flowing through the tubular is directed primarily along the lower portion of the tubular. Thus, the fluid flow pattern is affected by the relative density of the fluid. In response to the change in fluid flow pattern, the valve assembly 700 moves between the open and closed positions. In the embodiment shown, the fluid control apparatus 525 is designed to select a fluid of a relatively higher density. That is, a more dense fluid, such as oil, will cause the diverter arm 602 to "float" to an open position, as in FIG. 22, thereby affecting the fluid flow pattern and opening the valve assembly 700. As the fluid changes to a lower density, such as gas, the diverter arm 602 "sinks" to the closed position and the affected fluid flow causes the valve assembly 700 to close, restricting flow of the less dense fluid.

A counterweight 601 may be used to adjust the fluid density at which the diverter arm 602 "floats" or "sinks" and can also be used to allow the material of the floater arm to have a significantly higher density than the fluid where the diverter arm "floats." As explained above in relation to the rotating diverter system, the relative buoyancy or effective density of the diverter arm in relation to the fluid density will determine the conditions under which the diverter arm will change between open and closed or upper and lower positions.

Of course, the embodiment seen in FIG. 21 can be designed to select more or less dense fluids as described elsewhere herein, and can be utilized in several processes and methods, as will be understood by one of skill in the art.

FIGS. 23-26 show further cross-section detail views of embodiments of a flow control apparatus utilizing a diverter arm as in FIG. 21. In FIG. 17, the flow controlled valve member 702 is a pivoting wedge 710 movable about pivot 711 between a closed position (shown) wherein the wedge 710 restricts flow through an outlet 712 extending through a wall 714 of the valve assembly 700, and an open position wherein the wedge 710 does not restrict flow through the outlet 712.

Figure 24:
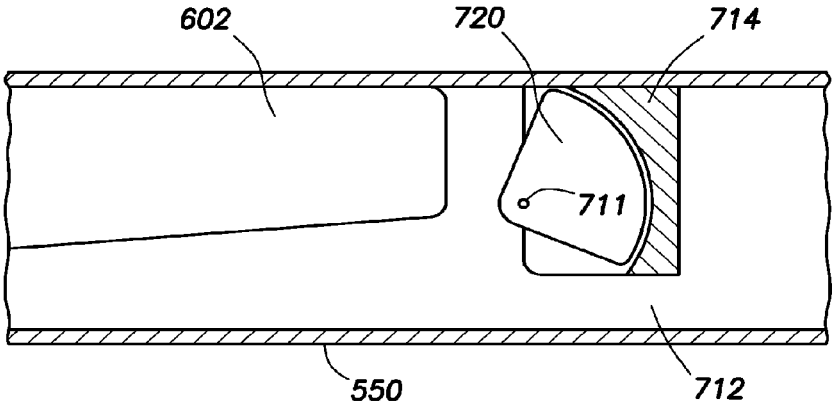

Similarly, FIG. 24 shows an embodiment having a pivoting wedge-shaped valve member 720. The wedge-shaped valve member 720 is seen in an open position with fluid flow unrestricted through valve outlet 712 along the bottom portion of the tubular. Note that the valve outlet 712 in this case is defined in part by the interior surface of the tubular and in part by the valve wall 714. The valve member 720 rotates about pivot 711 between and open and closed position.

Figure 25:
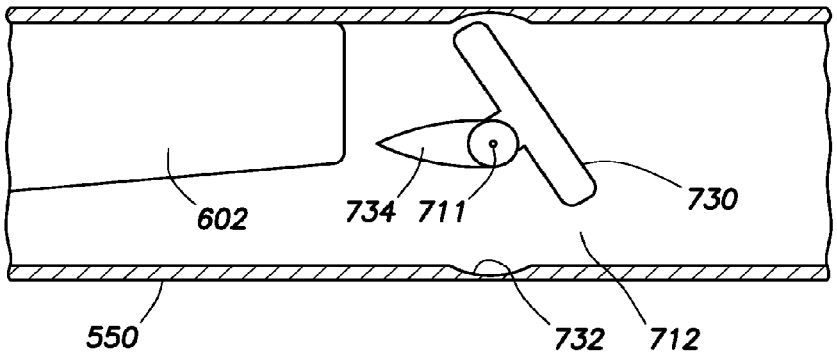

FIG. 25 shows another valve assembly embodiment having a pivoting disk valve member 730 which rotates about pivot 711 between an open position (shown) and a closed position. A stationary flow arm 734 can further be employed.

FIGS. 21-25 are exemplary embodiments of flow control apparatus having a movable diverter arm which affects fluid flow patterns within a tubular and a valve assembly which moves between an open and a closed position in response to the change in fluid flow pattern. The specifics of the embodiments are for example and are not limiting. The flow diverter arm can be movable about a pivot or pivots, slidable, flexures, or otherwise movable. The diverter can be made of any suitable material or combination of materials. The tubular can be circular in cross-section, as shown, or otherwise shaped. The diverter arm cross-section is shown as tapered at one end and substantially rectangular at the other end, but other shapes may be employed. The valve assemblies can include multiple outlets, stationary vanes, and shaped walls. The valve member may take any known shape which can be moved between an open and closed position by a change in fluid flow pattern, such as disk, wedge, etc. The valve member can further be movable about a pivot or pivots, slidable, bendable, or otherwise movable. The valve member can completely or partially restrict flow through the valve assembly. These and other examples will be apparent to one of skill in the art.

As with the other embodiments described herein, the embodiments in FIGS. 21-25 can be designed to select any fluid based on a target density. The diverter arm can be selected to provide differing flow patterns in response to fluid composition changes between oil, water, gas, etc., as described herein. These embodiments can also be used for various processes and methods such as production, injection, work-overs, cementing and reverse cementing.

Figure 26:
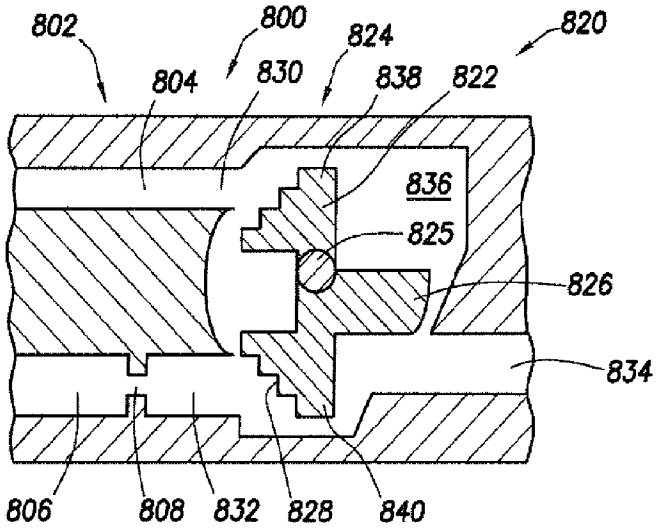

FIG. 26 is a schematic view of an embodiment of a flow control apparatus in accordance with the invention having a flow diverter actuated by fluid flow along dual flow paths. Flow control apparatus 800 has a dual flow path assembly 802 with a first flow path 804 and a second flow path 806. The two flow paths are designed to provide differing resistance to fluid flow. The resistance in at least one of the flow paths is dependent on changes in the viscosity, flow rate, density, velocity, or other fluid flow characteristic of the fluid. Exemplary flow paths and variations are described in detail in U.S. patent application Ser. No. 12/700,685, to Jason Dykstra, et al., filed Feb. 4, 2010, which application is hereby incorporated in its entirety for all purposes. Consequently, only an exemplary embodiment will be briefly described herein.

In the exemplary embodiment at FIG. 26, the first fluid flow path 804 is selected to impart a pressure loss on the fluid flowing through the path which is dependent on the properties of the fluid flow. The second flow path 806 is selected to have a different flow rate dependence on the properties of the fluid flow than the first flow path 804. For example, the first flow path can comprise a long narrow tubular section while the second flow path is an orifice-type pressure loss device having at least one orifice 808, as seen. The relative flow rates through the first and second flow paths define a flow ratio. As the properties of the fluid flow changes, the fluid flow ratio will change. In this example, when the fluid consists of a relatively larger proportion of oil or other viscous fluid, the flow ratio will be relatively low. As the fluid changes to a less viscous composition, such as when natural gas is present, the ratio will increase as fluid flow through the first path increases relative to flow through the second path.

Other flow path designs can be employed as taught in the incorporated reference, including multiple flow paths, multiple flow control devices, such as orifice plates, tortuous pathways, etc., can be employed. Further, the pathways can be designed to exhibit differing flow ratios in response to other fluid flow characteristics, such as flow rate, velocity, density, etc., as explained in the incorporated reference.

The valve assembly 820 has a first inlet 830 in fluid communication with the first flow path 804 and a second inlet 832 in fluid communication with the second flow path 806. A movable valve member 822 is positioned in a valve chamber 836 and moves or actuates in response to fluid flowing into the valve inlets 830 and 832. The movable valve member 822, in a preferred embodiment, rotates about pivot 825. Pivot 825 is positioned to control the pivoting of the valve member 822 and can be offset from center, as shown, to provide the desired response to flow from the inlets. Alternate movable valve members can rotate, pivot, slide, bend, flex, or otherwise move in response to fluid flow. In an example, the valve member 822 is designed to rotate about pivot 825 to an open position, seen in FIG. 20, when the fluid is composed of a relatively high amount of oil while moving to a closed position when the fluid changes to a relatively higher amount of natural gas. Again, the valve assembly and member can be designed to open and close when the fluid is of target amount of a fluid flow characteristic and can select oil versus natural gas, oil versus water, natural gas versus water, etc.

The movable valve member 822 has a flow sensor 824 with first and second flow sensor arms 838 and 840, respectively. The flow sensor 824 moves in response to changes in flow pattern from fluid through inlets 830 and 832. Specifically, the first sensor arm 838 is positioned in the flow path from the first inlet 830 and the second sensor arm 840 is positioned in the flow path of the second inlet 832. Each of the sensor arms has impingement surfaces 828. In a preferred embodiment, the impingement surfaces 828 are of a stair-step design to maximize the hydraulic force as the part rotates. The valve member 822 also has a restriction arm 826 which can restrict the valve outlet 834. When the valve member is in the open position, as shown, the restriction arm allows fluid flow through the outlet with no or minimal restriction. As the valve member rotates to a closed position, the restriction arm 826 moves to restrict fluid flow through the valve outlet. The valve can restrict fluid flow through the outlet partially or completely.

Figure 27:
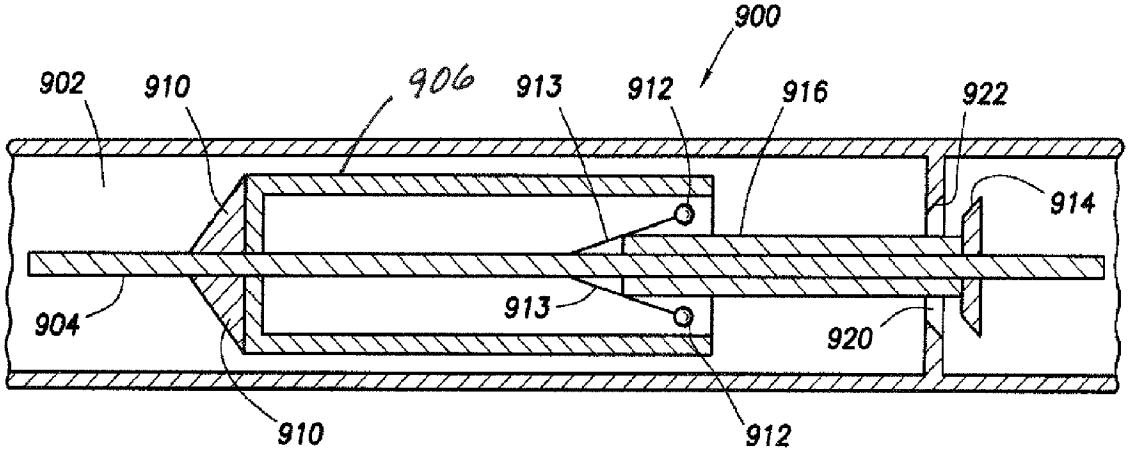
FIG. 27 is a side cross-sectional view of another embodiment of the fluid control apparatus having a rotating flow-driven resistance assembly, shown in an open position, according to one aspect of the invention.

FIG. 27 is a cross-sectional side view of another embodiment of a flow control apparatus 900 of the invention having a rotating flow-driven resistance assembly. Fluid flows into the tubular passageway 902 and causes rotation of the rotational flow-driven resistance assembly 904. The fluid flow imparts rotation to the directional vanes 910 which are attached to the rotational member 906. The rotational member is movably positioned in the tubular to rotate about a longitudinal axis of rotation. As the rotational member 906 rotates, angular force is applied to the balance members 912. The faster the rotation, the more force imparted to the balance members and the greater their tendency to move radially outward from the axis of rotation. The balance members 912 are shown as spherical weights, but can take other alternative form. At a relatively low rate of rotation, the valve support member 916 and attached restriction member 914 remain in the open position, seen in FIG. 27. Each of the balance members 912 is movably attached to the rotational member 906, in a preferred embodiment, by balance arms 913. The balance arms 913 are attached to the valve support member 916 which is slidably mounted on the rotational member 906. As the balance members move radially outward, the balance arms pivot radially outwardly, thereby moving the valve support member longitudinally towards a closed position. In the closed position, the valve support member is moved longitudinally in an upstream direction (to the left in FIG. 27) with a corresponding movement of the restriction member 914. Restriction member 914 cooperates with the valve wall 922 to restrict fluid flow through valve outlet 920 when in the closed position. The restriction of fluid flow through the outlet depends on the rate of rotation of the rotational flow-driven resistance assembly 904.

Figure 28:
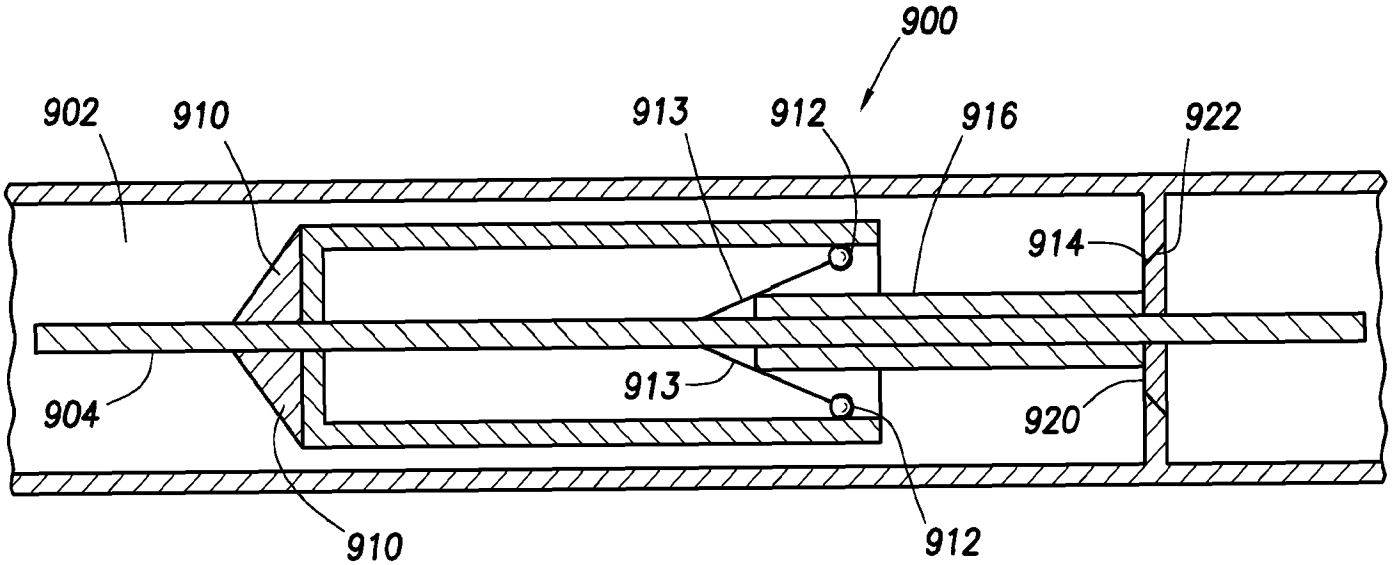
FIG. 28 is a side cross-sectional view of the embodiment seen in FIG. 27 having a rotating flow-driven resistance assembly, shown in a closed position.

FIG. 28 is a cross-sectional side view of the embodiment of the flow control apparatus 900 of FIG. 27 in a closed position. Fluid flow in the tubular passageway 902 has caused rotation of the rotational flow-driven resistance assembly 904. At a relatively high rate of rotation, the valve support member 916 and attached restriction member 914 move to the closed position seen in FIG. 28. The balance members 912 are moved radially outward from the longitudinal axis by centrifugal force, pivoting balance arms 913 away from the longitudinal axis. The balance arms 913 are attached to the valve support member 916 which is slidably moved on the rotational member 906. The balance members have moved radially outward, the balance arms pivoted radially outward, thereby moving the valve support member longitudinally towards the closed position shown. In the closed position, the valve support member is moved longitudinally in an upstream direction with a corresponding movement of the restriction member 914. Restriction member 914 cooperates with the valve wall 922 to restrict fluid flow through valve outlet 920 when in the closed position. The restriction of fluid flow through the outlet depends on the rate of rotation of the rotational flow-driven resistance assembly 904. The restriction of flow can be partial or complete. When the fluid flow slows or stops due to movement of the restriction member 914, the rotational speed of the assembly will slow and the valve will once again move to the open position. For this purpose, the assembly can be biased towards the open position by a biasing member, such as a bias spring or the like. It is expected that the assembly will open and close cyclically as the restriction member position changes.

The rotational rate of the rotation assembly depends on a selected characteristic of the fluid or fluid flow. For example, the rotational assembly shown is viscosity dependent, with greater resistance to rotational movement when the fluid is of a relatively high viscosity. As the viscosity of the fluid decreases, the rotational rate of the rotation assembly increases, thereby restricting flow through the valve outlet. Alternately, the rotational assembly can rotate at varying rates in response to other fluid characteristics such as velocity, flow rate, density, etc., as described herein. The rotational flow-driven assembly can be utilized to restricted flow of fluid of a pre-selected target characteristic. In such a manner, the assembly can be used to allow flow of the fluid when it is of a target composition, such as relatively high oil content, while restricting flow when the fluid changes to a relatively higher content of a less viscous component, such as natural gas. Similarly, the assembly can be designed to select oil over water, natural gas over water, or natural gas over oil in a production method. The assembly can also be used in other processes, such as cementing, injection, work-overs and other methods.

Further, alternate designs are available for the rotational flow-driven resistance assembly. The balances, balance arms, vanes, restriction member and restriction support member can all be of alternate design and can be positioned up or downstream of one another. Other design decisions will be apparent to those of skill in the art.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

The invention claimed is:

1. A fluid flow control apparatus for use in an oilfield tubular positioned in a wellbore extending through a subterranean formation, the oilfield tubular for flowing fluid therethrough, the apparatus comprising:

a tubular defining a fluid passageway;

a port positioned in the passageway;

a rotational, fluid-driven valve member, the valve member mounted for rotation about a longitudinal axis in the passageway, fluid flow through the fluid passageway imparting rotation to the valve member, wherein the valve member comprises a plurality of balance members mounted for radial movement in response to rotation of the valve member; and a valve restriction member movably mounted to the valve member and movable to restrict flow through the port.

2. The apparatus as in claim 1, the valve restriction member mounted to move longitudinally in the tubular passageway.

3. The apparatus as in claim 2, wherein the valve restriction member moves between an open position wherein flow through the port is unrestricted and a closed position wherein flow through the port is restricted.

4. The apparatus as in claim 1, wherein the rotation rate of the valve member is responsive to changes in a fluid flow characteristic.

5. The apparatus as in claim 4, wherein the fluid flow characteristic is viscosity, velocity, flow rate, or density.

6. The apparatus as in claim 5, wherein fluid flow through the port is restricted when the fluid reaches a preselected viscosity.

7. The apparatus as in claim 6, wherein the fluid flow is restricted at a lower viscosity and fluid flow is unrestricted at a higher viscosity.

8. The apparatus as in claim 1, wherein the balance members are pivotally mounted to move radially in response to rotation of the valve member.

9. The apparatus as in claim 1, wherein radial movement of the balance members causes longitudinal movement of the valve restriction member.

10. The apparatus as in claim 1, wherein the valve restriction member moves in response to centrifugal force exerted on the valve member.

* * * * *